US006986692B1

(12) United States Patent
Yanagisawa

(10) Patent No.: US 6,986,692 B1
(45) Date of Patent: Jan. 17, 2006

(54) PRODUCTION METHOD OF IMAGE-FORMING APPARATUS, AND IMAGE-FORMING APPARATUS PRODUCED BY THE PRODUCTION METHOD

(75) Inventor: Yoshihiro Yanagisawa, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 09/722,705

(22) Filed: Nov. 28, 2000

Related U.S. Application Data

(63) Continuation of application No. PCT/JP99/05636, filed on Oct. 13, 1999.

(30) Foreign Application Priority Data

Oct. 14, 1998 (JP) ..... 10-291939
Feb. 25, 1999 (JP) ..... 11-049027

(51) Int. Cl.
*H01J 9/24* (2006.01)

(52) U.S. Cl. ..... 445/24

(58) Field of Classification Search ..... 445/24, 445/25, 50, 51, 6; 313/495–497
See application file for complete search history.

(56) References Cited

U.S. PATENT DOCUMENTS 5,593,335 A * 1/1997 Suzuki et al. ..... 445/50
5,594,296 A * 1/1997 Mitsutake et al. ..... 313/309
5,659,329 A 8/1997 Yamanobe et al.
5,760,538 A * 6/1998 Mitsutake et al. ..... 313/422
5,831,387 A 11/1998 Kaneko et al.
5,839,363 A 11/1998 Yanagisawa et al.
5,912,531 A 6/1999 Hasegawa et al.

(Continued)

FOREIGN PATENT DOCUMENTS

EP 0 736 892 10/1996
JP 04-069991 3/1992
JP 06-342636 12/1994
JP 07-235256 9/1995

(Continued)

*Primary Examiner*—Joseph Williams
(74) *Attorney, Agent, or Firm*—Fitzpatrick, Cella, Harper & Scinto

(57) ABSTRACT

A method of producing an image-forming apparatus wherein a face plate having phosphors of the three primary colors is opposed to a rear plate comprising a plurality of electron-emitting devices, each having a first electrode and a second electrode, and a plurality of column-directional wires and row-directional wires connected to the plurality of electron-emitting devices, the method comprising: a step of arranging a plurality of first electrodes and second electrodes on the rear plate; a step of forming a plurality of column-directional wires, wherein each of the column-directional wires connects commonly a plurality of said first electrodes; a step of forming a plurality of row-directional wires, wherein each of the row-directional wires connects commonly a plurality of said second electrodes, the row direction is substantially perpendicular to the column direction, and intervals of the row-directional wires are larger than those of the column-directional wires; a step of forming an insulating layer between said row-directional wire and column-directional wire at each of intersections between the row-directional wires and column-directional wires; and a step of applying a liquid containing at least a metal or a semiconductor so as to connect the first and second electrodes to each other according to an ink jet method, wherein the step of forming the column-directional wires comprises: a step of forming a film comprising a photosensitive material and an electro-conductive material on the rear plate; a step of irradiating desired areas of the film with light; a step of patterning the film; and a step of baking the patterned film.

16 Claims, 19 Drawing Sheets

U.S. PATENT DOCUMENTS

| | | | | | |
|---|---|---|---|---|---|
| 5,996,488 | A | * | 12/1999 | Yanagisawa et al. | 101/170 |
| 6,060,113 | A | * | 5/2000 | Banno et al. | 427/10 |
| 6,087,770 | A | | 7/2000 | Kaneko et al. | |
| 6,123,876 | A | | 9/2000 | Kobayashi et al. | |
| 6,137,218 | A | | 10/2000 | Kaneko et al. | |
| 6,312,864 | B1 | * | 11/2001 | Tokai et al. | 445/24 |
| 6,313,571 | B1 | | 11/2001 | Hasegawa et al. | |
| 6,409,566 | B1 | | 6/2002 | Hasegawa et al. | |

FOREIGN PATENT DOCUMENTS

| | | |
|---|---|---|
| JP | 08-007745 | 1/1996 |
| JP | 08-034110 | 2/1996 |
| JP | 08-045448 | 2/1996 |
| JP | 08-171850 | 7/1996 |
| JP | 08-236017 | 9/1996 |
| JP | 09-022671 | 1/1997 |
| JP | 09-069334 | 3/1997 |
| JP | 09-102271 | 4/1997 |
| JP | 09-106755 | 4/1997 |
| JP | 09-129119 | 5/1997 |
| JP | 09-129121 | 5/1997 |
| JP | 09-129125 | 5/1997 |
| JP | 09-138509 | 5/1997 |
| JP | 09-161666 | 6/1997 |
| JP | 09-245690 | 9/1997 |
| JP | 09-259741 | 10/1997 |
| JP | 09-259742 | 10/1997 |
| JP | 09-274847 | 10/1997 |
| JP | 09-283012 | 10/1997 |
| JP | 09-283013 | 10/1997 |
| JP | 09-306359 | 11/1997 |
| JP | 10-021822 | 1/1998 |
| JP | 10-021823 | 1/1998 |
| JP | 10-050207 | 2/1998 |
| JP | 10-050209 | 2/1998 |
| JP | 10-144204 | 5/1998 |
| JP | 10-326558 | 12/1998 |

* cited by examiner

100 : DEPRESSION
102, 103 : ELECTRODES
104 : CONDUCTIVE FILMS
105 : ELECTRON-EMITTING REGIONS
106 : ROW-DIRECTIONAL WIRES
107 : COLUMN-DIRECTIONAL WIRES
114 : INSULATING LAYERS

Y-DIRECTION
X-DIRECTION

PRODUCTION METHOD OF IMAGE-FORMING APPARATUS, AND IMAGE-FORMING APPARATUS PRODUCED BY THE PRODUCTION METHOD

This application is a continuation of International Application No. PCT/JP99/05636, filed Oct. 13, 1999, which claims the benefit of Japanese Patent Application No. 10-291939, filed Oct. 14, 1998 and Japanese Patent Application No. 11-049027 filed Feb. 25, 1999.

TECHNICAL FIELD

The present invention relates to a production method of wiring arrayed in a matrix pattern and used in image-forming apparatus. The invention also concerns an image-forming apparatus produced by the production method.

BACKGROUND ART

In recent years, thin emissive type image display devices have been drawing attention as image display devices replacing LCDs. Examples of the emissive type image display devices include plasma display panels (PDP), flat panel displays using an electron source of such cold cathodes as field emission type electron-emitting devices (FE) or surface conduction type electron-emitting devices and effecting light emission by irradiating phosphors with electrons emitted from the electron-emitting devices, and so on.

In the display devices using the cold cathodes such as the above FE and surface conduction type electron-emitting devices, the principle of light emission is basically the same as that of cathode-ray tubes. For that reason, they have the potential of achieving the luminance and contrast basically equivalent to those of the cathode-ray tubes.

The image display devices using the surface conduction type electron-emitting devices are disclosed, for example, in Japanese Patent Applications Laid-Open Nos. 6-342636, 7-235256, 8-007745, 8-034110, 8-045448, 8-171850, 8-236017, 9-069334, 9-102271, 9-106755, 9-129119, 9-129121, 9-129125, 9-138509, 9-161666, 9-245690, 9-259741, 9-259742, 9-283012, 9-283013, 9-306359, 10-021822, 10-021823, 10-050207, 10-050209, 10-144204, and so on.

FIG. 9 and FIG. 10 show the schematic structure of an example of the surface conduction type electron-emitting devices disclosed in the above applications. FIG. 11 shows a schematic, structural diagram of an example of the image display apparatus using the surface conduction type electron-emitting devices, disclosed in the above applications.

FIG. 9 is a plan view of the surface conduction type electron-emitting device and FIG. 10 a cross-sectional view of the surface conduction type electron-emitting device. In FIG. 9 and FIG. 10, numeral 101 designates an insulating substrate, 104 an electroconductive film, 102 and 103 electrodes, and 105 an electron-emitting region. The electron-emitting region 105 has a gap. When a voltage is applied between the electrodes 102, 103, electrons are emitted from the electron-emitting region 105.

In FIG. 11, numeral 108 designates a rear plate, 109 an outer frame, and 110 a face plate. Joint parts of the outer frame 109, rear plate 108, and face plate 110 are sealed with an adhesive of low melting glass frit or the like not illustrated, thereby composing an envelope (airtight vessel) for maintaining the inside of the image display device in vacuum. The substrate 101 is fixed to the rear plate 108. The surface conduction type electron-emitting devices 113 are arrayed in the matrix of N×M on the substrate 101 (where N and M are positive integers not less than two and properly set according to the number of pixels in an objective display image). The phosphors are arranged opposite to the respective electron-emitting devices.

The electron-emitting devices 113 are wired in the matrix with M column-directional wires 107 and N row-directional wires 106, as illustrated in FIG. 11. Unrepresented insulating layers for electrically insulating the wires from each other are formed at least at intersecting portions between the row-directional wires and the column-directional wires.

A fluorescent film 111 consisting of the phosphors is formed on a lower surface of the face plate 110. A metal back 112 of Al or the like is formed on a surface of the fluorescent film 111 opposite to the rear plate 108.

In the case of color display, the phosphors (not illustrated) of the three primary colors of red (R), green (G), and blue (B) are separately laid. A black material (not illustrated) is laid between the above phosphors of the respective colors forming the fluorescent film 111.

The inside of the above envelope (airtight vessel) is maintained in the vacuum of pressure lower than $10^{-4}$ Pa. In this way, the clearance is normally kept in the distance of several hundred $\mu$m to several mm between the substrate 101 with the electron-emitting devices formed thereon and the face plate 110 with the fluorescent film formed thereon.

In a driving method of the image display device described above, a voltage is applied to each electron-emitting device 113 through external terminals Dx1 to Dxm, Dy1 to Dyn and through the wires 106 and 107, whereupon each device 113 emits electrons. At the same time as it, a high voltage of several hundred V to several kV is applied through an external terminal Hv to the metal back 112. This causes the electrons emitted from each device 113 to be accelerated and collide with each corresponding color phosphor. The electrons excite the phosphors to induce emission of light, whereby an image is displayed.

DISCLOSURE OF THE INVENTION

In the case of the flat panel displays of color display using the electron-emitting devices of the cold cathode type described above, it is desirable to satisfy two points below in order to shorten the distance between the face plate and the rear plate, facilitate their production, and simplify driving of the devices.

The two points are as follows:

(1) at least one cold cathode is assigned to each phosphor of R (red), G (green), and B (blue). Preferably, one electron-emitting device is assigned to the phosphor of each color;

(2) the electron-emitting devices are matrix-driven.

Concerning the above requirement (1), the electrons emitted from the devices form beam spots approximately in an elliptic shape on the phosphors in the case of the lateral electron-emitting devices (the surface conduction type electron-emitting devices illustrated in FIG. 9, the lateral FE, for example, in the form illustrated in FIG. 14, etc.). The lateral electron-emitting devices stated herein are devices in each of which at least a pair of electrodes are placed on the substrate and in each of which a potential difference is made between the electrodes to emit electrons between the pair of electrodes. Then the electrons emitted from the lateral electron-emitting device are affected by the electric field made by the anode (such as the metal back described above or the like) and by the electric field established between the electrodes. For that reason, the electrons emitted from the lateral electron-emitting device reach the anode at a place with a shift from immediately above between the electrodes toward the high-potential-side electrode. Further, the beam spots are formed in the elliptic (vertically long) shape, as described previously, because of the action of the electric field between the electrodes.

Concerning the above requirement (1), it is further desirable to make the shape of a pixel consisting of adjacent phosphors of the three primary colors, as close to a square as possible in terms of appearance of the displayed image and easiness of processing of image signals. When a pixel is formed in the shape close to a square, the shape assigned to the phosphor of each color becomes rectangular, as illustrated in FIG. 12. In the simplest consideration, the ratio of the longer side to the shorter side of the rectangle is 3:1.

From these factors, it is preferable to make patterns of the phosphors of the respective colors rectangular, particularly, in the case of the face plate of the flat panel displays using the lateral electron-emitting devices such as the surface conduction type electron-emitting devices or the lateral FE. The reasons are that it is effective to get sufficient irradiation areas of the electron beams onto the phosphors in order to get more light emission amounts from the phosphors, that the rectangular patterns are effective for achieving the pixels in the shape close to the square from the aforementioned purpose, and so on.

On the other hand, from the above requirements (1) and (2) and easiness of production, the electron-emitting devices are preferably placed within the areas surrounded by the wires (106, 107) perpendicular to each other, as illustrated in FIG. 11, on the rear plate of the flat panel displays using the lateral electron-emitting devices. For this reason, where the patterns of the respective color phosphors are rectangular as described above, the areas surrounded by the wires, assigned to the respective devices, are also desirably rectangular.

However, where the areas for formation of the lateral electron-emitting devices (the areas surrounded by the wires) are rectangular as described above, wire intervals of the wires arrayed at equal intervals in the shorter-side direction of the rectangles (hereinafter referred to as column-directional wires) are shorter than those of the wires arrayed at equal intervals in the longer-side direction (hereinafter referred to row-directional wires). In the simplest consideration, as described previously, the intervals of the column-directional wires are a third of those of the row-directional wires. Therefore, required precision of the column-directional wires becomes higher than that of the row-directional wires. Further, the tolerable width of the column-directional wires is narrower than that of the row-directional wires in consideration of a margin for the above precision.

Recently, there are demands for displays of much larger area and higher definition. In order to meet the demands, it is necessary to increase the thickness so as to keep the resistance from increasing, while decreasing the width of the wires.

Against these demands, methods of depositing a wire material by sputtering, evaporation, or the like and thereafter etching it to form the wires are not suitable for large areas because they do not allow the wires to be formed in sufficient thickness. On the other hand, printing methods are capable of forming the wires in large thickness and in large area readily at low cost, but it is difficult to meet the aforementioned requirements for the column-directional wires. Specifically, the sputtering methods and the like do not allow formation of the wires in sufficient thickness and it is difficult to deposit the wire material at one time over a large area. If the wires are formed by a screen printing method, there will be a tendency that the patterns become dull at ends; thus the thickness will become smaller or the width will become wider than that of required patterns.

In the ordinary screen printing methods, as illustrated in FIG. 15, a desired pattern is formed by applying a paste containing an electroconductive material through openings of gauze (for example, woven meshes of metal wires or the like) 10 onto a substrate and baking it. Numeral 11 in FIG. 15 denotes an emulsion film with openings corresponding to the pattern formed. Since this gauze (mesh) exists, the metal wires impede the paste from passing, so that the width of the printed wires has wide and narrow portions as illustrated in FIG. 16. Further, since the paste was applied onto the substrate with pushing a squeegee against the gauze (mesh) in the screen printing, there readily occurred positional deviation of the pattern and it was difficult to form an accurate pattern in certain cases.

It is preferable to form the electroconductive film (104 in FIG. 9) constituting the devices, by an ink jet method, particularly, for making the flat panel display with the surface conduction type electron-emitting devices in a large area, at low cost, and simply. Specifically, a liquid (ink) containing a material for the electroconductive film is applied so as to connect the electrodes (102, 103) to each other and is baked to form the electroconductive film 104. Then electric current is allowed to flow through the electrodes 102, 103 to the electroconductive film 104, so as to form a gap in part of the conductive film. As a consequence, the aforementioned electron-emitting region 105 is made. However, there sometimes occurred deviation of application position of droplet of the liquid in the ink jet method.

There were thus cases wherein when the wires (particularly, the above column-directional wires) surrounding the conductive film 104 were made by the printing method, a droplet delivered went into contact with and was sucked into the column-directional wire closest to the intended position of the ink (liquid).

This is conceivably because the wires formed by printing normally lack denseness and the ink is easy to soak thereinto.

Further, this phenomenon appears prominent when the column-directional wires are formed by the screen printing method. The wires formed by the screen printing method tend to have the periodic, wide and narrow portions in the wire width, as described referring to FIG. 16. For this reason, where the wire width is wide in the column-directional wire located at the position closest to the intended position of the ink, the ink becomes easier to go into contact therewith.

If the droplet was sucked into the wire as described above, there occurred pixel loss in the worst case and it could be a fatal defect to the display. Even if the pixel loss was not encountered, there occurred difference in electron emission characteristics, desired luminance was not achieved, and the image was formed with poor uniformity in certain cases.

The present invention has been accomplished in view of the above issues and provides a method of producing an image-forming apparatus, which can realize high-definition and large-area display images with high uniformity, without pixel loss, and at low cost over a long period.

A method of producing an image-forming apparatus according to the present invention, comprises the following steps.

Specifically, a first mode of the production method of the image-forming apparatus according to the present invention is a method of producing an image-forming apparatus wherein a rear plate, which comprises a plurality of electron-emitting devices each having a first electrode and a second electrode opposed to each other and a plurality of column-directional wires and row-directional wires connected to the plurality of electron-emitting devices, is opposed to a face plate having phosphors of the three primary colors, said method comprising:

(a) a step of disposing a plurality of first electrodes and second electrodes on a rear plate;

(b) a step of forming a plurality of column-directional wires, wherein each of said column-directional wires connects a plurality of said first electrodes on a common basis;

(c) a step of forming a plurality of row-directional wires, wherein each of said row-directional wires connects a plurality of said second electrodes on a common basis, wherein said row-direction is substantially perpendicular to the column-direction, and wherein intervals of said row-directional wires are larger than those of said column-directional wires;

(d) a step of forming an insulating layer between said row-directional and column-directional wires at each intersection between said row-directional and column-directional wires; and (e) a step of applying a liquid containing at least a metal or semiconductor element so as to connect said first electrode and second electrode to each other by an ink jet method, wherein the step of forming said column-directional wires comprises a step of forming a film comprising a photosensitive material and an electroconductive material on said rear plate, a step of irradiating desired areas of said film with light, a step of patterning said film, and a step of baking said patterned film.

A second mode of the production method of the image-forming apparatus according to the present invention is a method of producing an image-forming apparatus wherein a rear plate, which comprises a plurality of electron-emitting devices each having a first electrode and a second electrode and a plurality of wires connected to the plurality of electron-emitting devices, is opposed to a face plate having a phosphor, said method comprising:

(a) a step of disposing a plurality of first electrodes and second electrodes on the rear plate;

(b) a step of selectively forming a film comprising a photosensitive material and an electroconductive material on said rear plate through apertures of a mask having the apertures of a desired shape;

(c) a step of irradiating desired areas of said film with light;

(d) a step of patterning said film;

(e) a step of baking said patterning film to form a plurality of wires connected to the electrodes; and (f) a step of forming an electroconductive film so as to connect said first electrode and second electrode to each other.

BEST MODE FOR CARRYING OUT THE INVENTION

An example of the structure of the image-forming apparatus to which the production method of the present invention is preferably applicable, will first be described referring to FIG. 17, FIG. 12, FIG. 13, and FIG. 9. It is noted that members denoted by the same reference symbols designate the same elements among the figures. It is also noted that the X-direction and Y-direction are common to the drawings.

Figure 17:
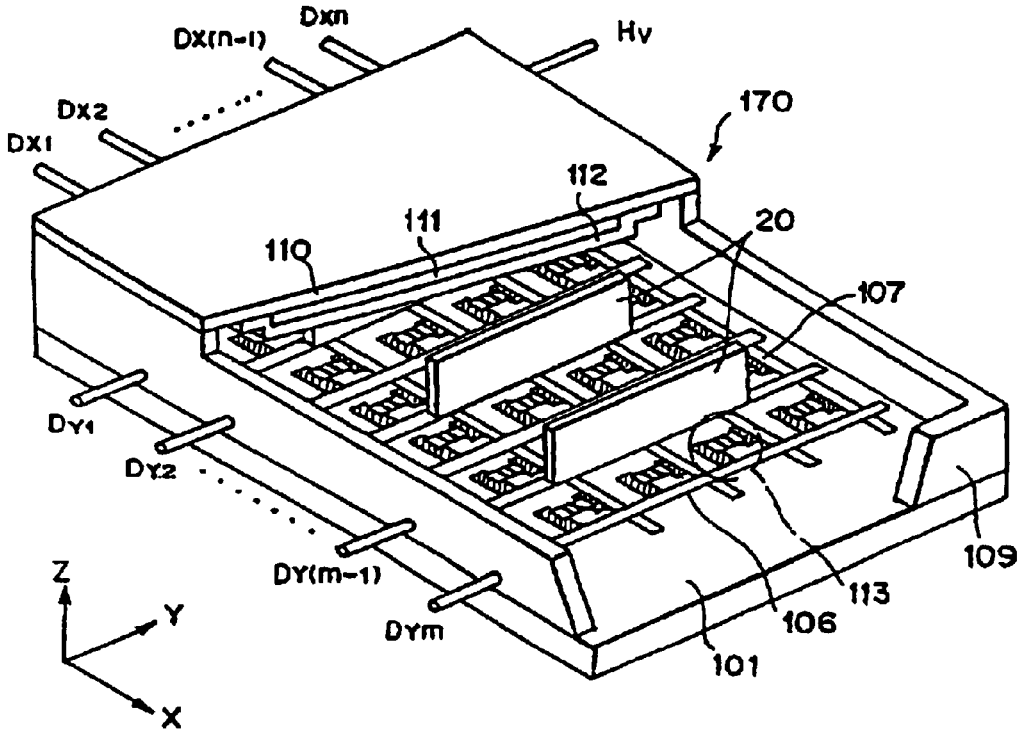
FIG. 17 is a perspective view of a flat panel display formed according to the present invention.

FIG. 17 is a schematic diagram to show the structure of the image display device (flat panel display) to which the present invention is preferably applicable. In FIG. 17, numeral 101 designates the rear plate, 109 the outer frame, and 110 the face plate. The joint parts of the outer frame 109, rear plate 101, and face plate 110 are sealed with an adhesive material of low melting glass frit or the like not illustrated, thereby composing an envelope (airtight vessel) for maintaining the inside of the image display device in vacuum. The surface conduction type electron-emitting devices 113 are formed in the array of N×M on the rear plate 101 (where N and M are positive integers not less than two and properly set according to the intended number of display pixels). Then the electron-emitting devices and the phosphors of the respective colors are placed in one-to-one correspondence and in an opposed state. Since the image display device of the present invention is of color display, a pixel is comprised of the phosphors of the three primary colors. A surface conduction type electron-emitting device corresponds to a phosphor of each color.

The above numbers N, M are determined depending upon the display area of the image-forming apparatus to be produced, the definition of the display image, and the aspect ratio of the display image. Thus N is set to 3000 and M to 1000 in the present example, but the numbers do not have to be limited to these.

The devices 113 are matrix-wired with N column-directional wires 107 arranged in a first direction (in the X-direction) and M row-directional wires 106 arranged in a second direction (in the Y-direction), as illustrated in FIG. 17.

Figure 10:
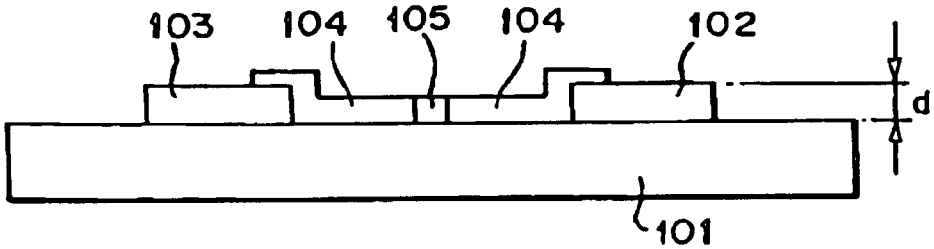
FIG. 10 is a cross-sectional view to show the structure of the surface conduction type electron-emitting device.
Figure 11:
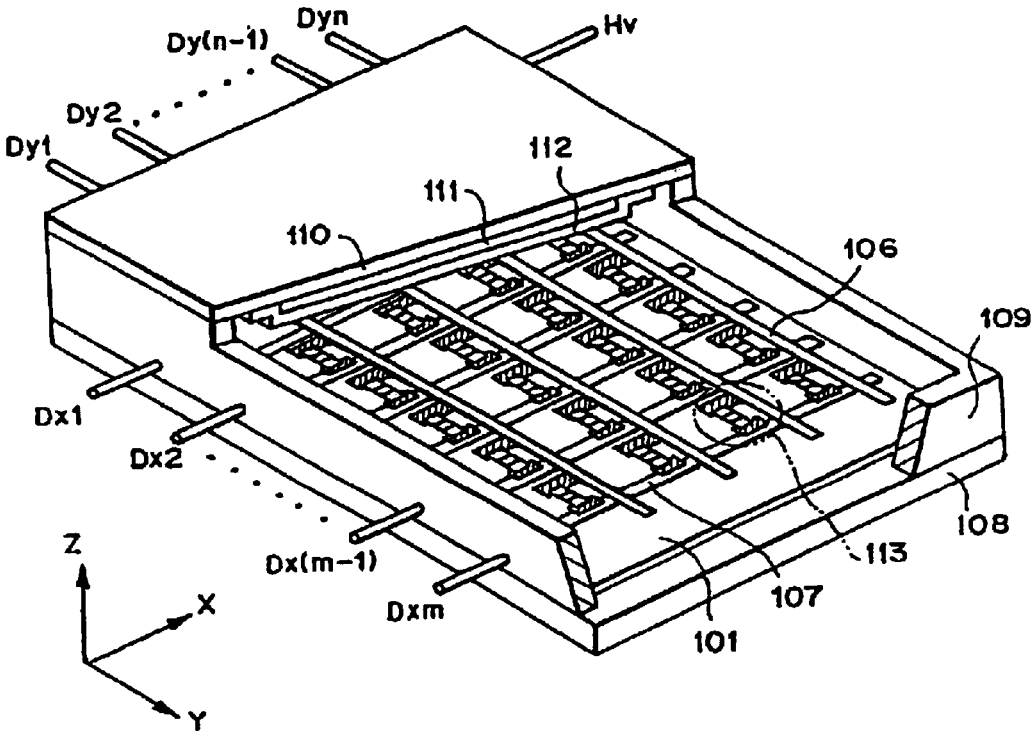
FIG. 11 is a schematic, perspective view of the image-forming apparatus.
Figure 13:
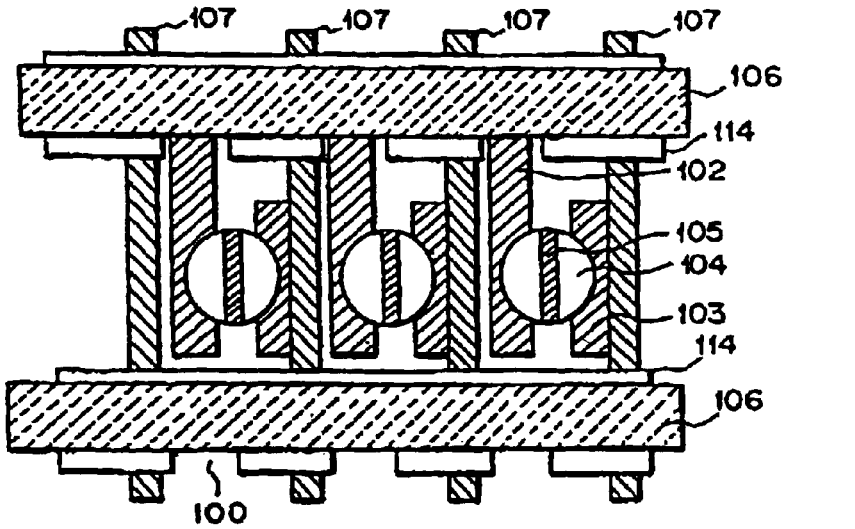
FIG. 13 is a plan view of the electron source produced according to the present invention.

FIG. 13 is a schematic diagram to show an enlarged view of the column-directional wires 107, row-directional wires 106, and surface conduction type electron-emitting devices 113 formed on the rear plate 101. The structure of the devices 113 themselves is the same as that illustrated in FIG. 9 and FIG. 10, except that the shape of the electroconductive film 104 is a circular shape specific to those formed by the ink jet method.

As illustrated in FIG. 13, insulating layers 114 for electrically insulating the two types of wires from each other are formed at least at the intersecting portions between the row-directional wires 106 and the column-directional wires 107.

The rear plate 101 can be made of a material selected from glass with a reduced impurity content of Na or the like, soda lime glass, a glass substrate obtained by depositing $SiO_2$ on soda lime glass by sputtering or the like, ceramics such as alumina or the like, a Si substrate, and so on.

A material for the opposed electrodes 102, 103 can be selected from the ordinary, conductive materials. It can properly be selected, for example, from metals or alloys of Ni, Cr, Au, Mo, W, Pt. Ti, Al, Cu, Pd, and so on, print conductors consisting of a metal or a metallic oxide such as Pd, Ag, Au, $RuO_2$, Pd-Ag, etc., and glass or the like, transparent conductors such as $In_2O_3$—$SnO_2$ or the like, semiconductor materials such as polysilicon or the like, and so on.

The shape including the distance L between the electrodes 102 and 103, the electrode width W1, the width W2 of the electroconductive film 4, etc. is properly designed in consideration of an application form or the like. The distance L between the electrodes 102, 103 can be set preferably in the range of several hundred nm to several hundred $\mu$m and more preferably in the range of several $\mu$m to several ten $\mu$m. The length W1 of the electrodes 102, 103 can be determined in the range of several $\mu$m to several hundred $\mu$m in consideration of the resistance and electron emission characteristics of these electrodes 102, 103. The thickness d of the electrodes 102 and 103 can be determined in the range of several ten nm to several $\mu$m.

The electrodes 102, 103 are provided for making secure electric connection between the electroconductive films 104 and the column-directional wires 107/row-directional wires 106. The reason is that if the electroconductive films 104 were coupled directly to the wires 106, 107 described hereinafter there would sometimes occur insufficient connection because of the difference between their film thicknesses.

The electroconductive films are formed by applying a below-stated liquid containing a material for the electroconductive films onto between the electrodes 102, 103 by the ink jet method and baking it. The material for the electroconductive films 104 is properly selected from metals of Pd, Pt, Ru, Ag, Au, Ti, In, Cu, Cr, Fe, Zn, Sn, Ta, W, Pd, etc., semiconductors including Si, Ge, etc., and further from oxides, borides, carbides, nitrides, etc. thereof. From the viewpoint of forming described hereinafter, it is particularly preferable to use Pd because of easiness to adjust the resistance by oxidation and reduction.

The ink jet method is a method of burying a heating resistor in a nozzle and boiling the liquid by heat thereof to eject a liquid droplet by the pressure of a bubble formed thereby (a bubble jet (BJ) method) or a method of applying an electric signal to a piezo device to deform it and induce change in the volume of a liquid chamber to eject a liquid droplet (a piezo jet (PJ) method), whereby the liquid containing the material for the above electroconductive films is ejected onto the positions where the conductive films are to be formed.

Figure 7:
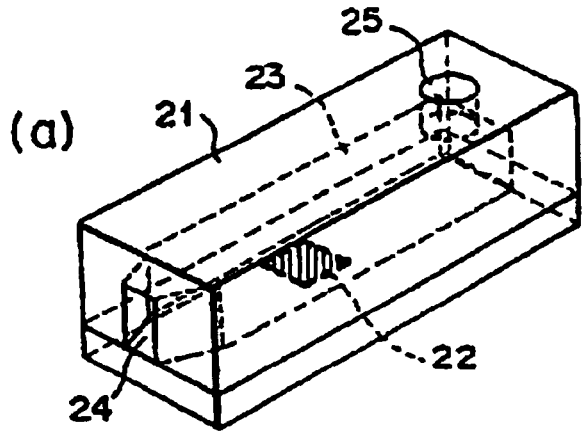
FIG. 7 is a schematic diagram of liquid droplet applying devices of the ink jet method.
Figure 7:
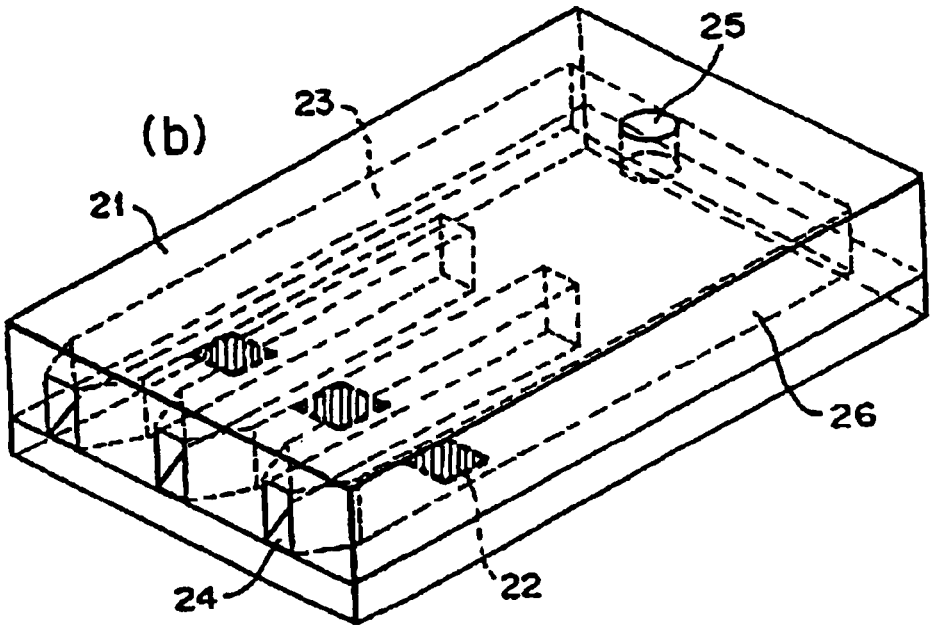

A schematic diagram of ink jet heads (ejection devices) used in the ink jet method is presented in FIG. 7. FIG. 7(*a*) shows the head 21 with a single nozzle, which has a single ejection port (nozzle) 24. FIG. 7(*b*) shows the head 21 with multiple nozzles, which has a plurality of droplet ejection ports (nozzles) 24. Particularly, the multi-nozzle head is effective, because it can shorten the time necessary for the application of the above liquid in production of displays necessitating formation of plural devices on the substrate. In FIG. 7, numeral 22 designates heaters or piezo devices, 23 flow paths of the ink (the above liquid), 25 a supply portion of the ink (the above liquid), and 26 a reservoir of the ink (the above liquid). A tank of the ink (the above liquid) is located apart from the head 21, and the above tank and head 21 are connected through a tube at the ink supply portion 25.

Liquids that can be used in the ink jet method include, for example, liquids in which particles of the aforementioned materials are dispersed, liquids containing compounds of complexes of the aforementioned materials or the like, and so on, but the liquids are not limited to these.

The thickness of the electroconductive films 104 is properly set in consideration of step coverage over the electrodes 102, 103, the resistance of the electrodes 102, 103, the FORMING conditions described hereinafter, and so on, and it is normally set preferably in the range of 1 nm to several hundred nm and more preferably in the range of 1 nm to 50 nm. The resistance thereof Rs is a value in the range of $10^2$ to $10^7$ [Ω/□]. This resistance Rs is a resistance where the resistance R of a thin film having the thickness of t, the width of w, and the length of L is defined as R=Rs (L/w).

The aforementioned thickness of the electrode 102, 103 is designed in consideration of the thickness of the electroconductive films 104.

The electrodes 102 and 103 are provided for making secure electric connection between the electroconductive films 104 and the row-directional wires 106/the column-directional wires 107 described hereinafter.

Since the electroconductive films 104 are very thin films, if they are formed before formation of the wires and electrodes they can undergo aggregation or the like because of the baking temperatures of the wires and electrodes. It is, therefore, preferable to perform formation of the electroconductive films after the steps of making the electrodes 102, 103 and the wires 106, 107. Since the electrodes 102, 103 are thicker than the electroconductive films but considerably thinner than the wires 106, 107, it is preferable to form the electrodes on the rear plate before formation of the wires. The production procedures are preferably carried out in the order of the step of forming the electrodes (102, 103)→the step of forming the wires (106, 107) and insulating layers (114)→the step of forming the conductive films accordingly. It is thus particularly preferable to effect such connection between the wires and the electrodes as to cover part of the electrodes by the wires.

From the above, in terms of the thickness, the electroconductive films (104) are the thinnest and then the thicknesses of the electrodes (102, 103), the column-directional wires (107), and the row-directional wires (106) decrease in the order named.

The difference between the thicknesses of the column-directional wires and the row-directional wires will be described later.

The column-directional wires 107 are wires made of a photosensitive, electroconductive paste (ink containing a photosensitive material and an electroconductive material for formation of wires). The column-directional wires are electrically connected to the electrodes while covering part of either one electrode forming each device 113. There are no specific restrictions on the material of the column-directional wires as long as it is an electric conductor. Preferred materials are those resistant to oxidation under heat in the air, and are preferably, for example, Ag, Au, Pt, and so on.

The form of the insulating layers 114 is a comb-teeth shape in FIG. 13, but the form is not limited to this shape. The point herein is that they are formed at least at the intersecting portions between the column-directional wires 107 and the row-directional wires 106. A method of forming the insulating layers 114 can be any method, but, preferably, is the screen printing method. Further, the insulating layers are preferably formed by carrying out exposure, development, and baking with use of a photosensitive insulating paste, as in the case of the column-directional wires 107.

The row-directional wires 106 are placed on the insulating layers of the comb-teeth shape in FIG. 13 and are electrically connected to the electrodes while covering part of either one electrode forming each device 113 in depressions 100 of the insulating layers 114. There are no specific restrictions on the material of the row-directional wires as long as it is an electric conductor. Preferably, preferred materials are those resistant to oxidation under heat in the atmosphere and are preferably, for example, Ag, Au, Pt, and so on.

As stated previously, the pitch of the column-directional wires 107 is set smaller than the pitch of the row-directional wires 106 in accordance with the pattern of the phosphors of the respective colors in the image-forming apparatus of the present example. The width of the column-directional wires is also set smaller than the width of the row-directional wires. Further, the cross-sectional area of the row-directional wires 106 is larger than that of the column-directional wires 107.

Figure 12:
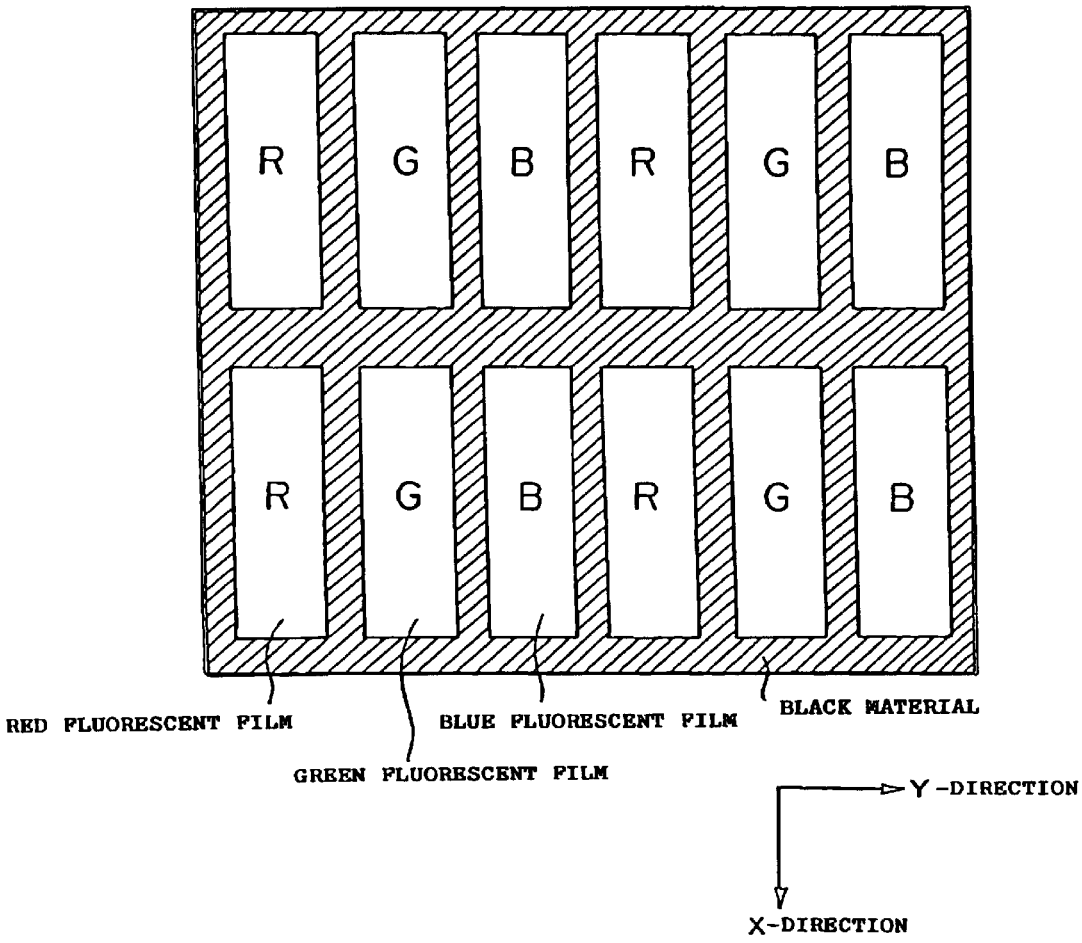
FIG. 12 is a plan view of the phosphors and black member used in the present invention.

On the other hand, the fluorescent film 111 is formed on the lower surface of the face plate 110. Since the display in the present invention is of color display, the part of the fluorescent film 111 consists of separate coatings of the phosphors of the three primary colors, red, green, and blue, used in the field of CRTs. The phosphors of the respective colors are separately laid, for example, in the rectangular shape as illustrated in FIG. 12 and the black member is placed between the phosphors. The black member herein is an electric conductor of black. The purposes for provision of the black member are to prevent deviation of displayed colors even with some deviation of irradiation positions of electrons, and to prevent degradation of display contrast by preventing reflection of ambient light. Particularly, the black member with electric conductivity is preferable, because it can prevent charge-up of the fluorescent film due to electrons. In this example, graphite was used as a principal component for the black member with electric conductivity, but it can also be any other material that suits the above purposes.

Figure 18:
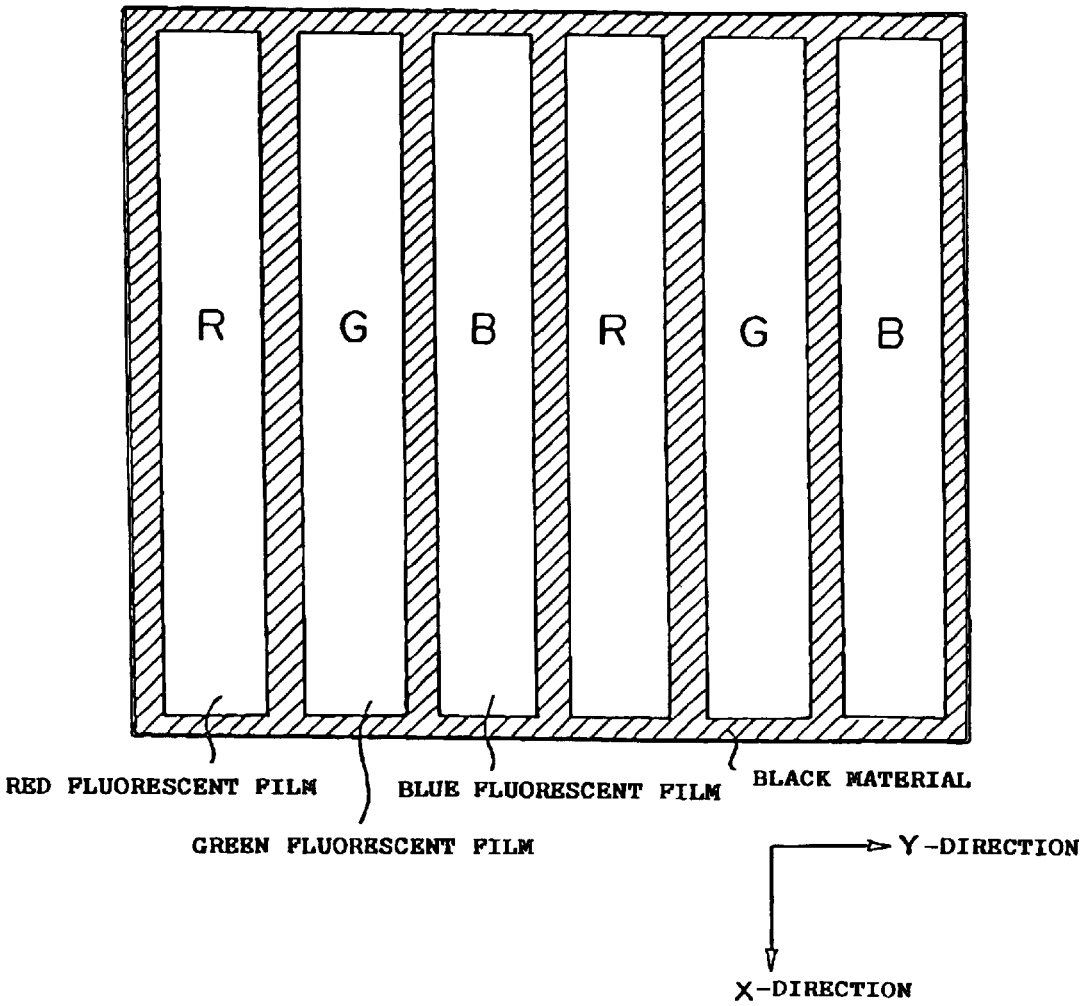
FIG. 18 is a plan view of the phosphors and black member that can be used in the present invention.

The pattern of the phosphors used in the present embodiment is presented in FIG. 12. The pattern of each color phosphor is a vertically long pattern (longer in the X-direction) in the image-forming apparatus of the present embodiment. This is for making the phosphor pattern of the three primary colors (R, G, B) nearly square as described previously and for effectively utilizing the beams of electrons, because the beam spot shape of the lateral electron-emitting devices typified by the surface conduction type electron-emitting devices is vertically long. The phosphor pattern herein is the grid shape in which the pattern of the black member is arranged in the X-direction and in the Y-direction, as illustrated in FIG. 12, but, besides it, the pattern may be a stripe shape in which the black member extends in the X-direction, as illustrated in FIG. 18. Namely, the pattern of the phosphors and the black member can be selected from the fluorescent patterns of different aspect ratios and the black member patterns with aperture patterns of different aspect ratios in accordance with the beams of the vertically long (elliptic) shape emitted from the electron-emitting devices. In order to enhance the contrast of the displayed image, it is particularly preferable to place the black member in the grid pattern as illustrated in FIG. 12.

The metal back 112 well known in the field of CRTs is provided on the rear-plate-side surface of the fluorescent film 111. The purposes for provision of this metal back 112 are to increase light utilization efficiency by specular reflection of part of light emitted from the fluorescent film 111, to protect the fluorescent film 111 from collision with negative ions, to make the metal back act as an electrode for applying an electro-accelerating voltage, to make it act as an electric path of electrons having excited the fluorescent film 111, and so on. This metal back 112 was formed by a method of forming the fluorescent film 111 on the face plate substrate 110, thereafter carrying out a smoothing process of the surface of the fluorescent film, and depositing aluminum (Al) thereon by vacuum evaporation. The metal back is not used where the fluorescent film 111 is made of a fluorescent material for low voltage.

Symbols Dx1 to Dxm, Dy1 to Dyn, and Hv denote terminals for electric connection of the airtight structure provided for electrically connecting the image display device with electric circuits not illustrated. The terminals Dx1 to Dxm are electrically connected to the row-directional wires 106 of the multi-electron beam source. The terminals Dy1 to Dyn are also electrically connected to the column-directional wires 107 of the multi-electron beam source similarly. The terminal Hv is electrically connected to the metal back 112.

The inside of the above envelope (airtight vessel) is maintained in a pressure lower than $10^{-4}$ Pa. With increase of the display screen size of the image display device, it thus becomes necessary to provide a means for preventing deformation or breakage of the rear plate 108 and the face plate 110 due to the pressure difference between inside and outside the envelope (airtight vessel). For that purpose, spacers 20 for supports standing the atmospheric pressure are placed between the face plate 110 and the rear plate 101 in the display of the present embodiment illustrated in FIG. 17.

As described above, the space is kept in the range of several hundred μm to several mm between the substrate 101 with the electron-emitting device 113 formed thereon and the face plate 110 with the fluorescent film formed thereon, and the inside of the envelope (airtight vessel) 170 is maintained in high vacuum.

In the image display device described above, when the voltage is applied to each electron-emitting device 113 through the external terminals Dx1 to Dxm, Dy1 to Dyn and through the row-directional wire 106 and column-directional wire 107, each device 113 emits electrons. At the same time as it, the high voltage of several hundred V to several kV is applied through the external terminal Hv to the metal back 112. This accelerates the electrons emitted from each device 113 and make them collide with the corresponding phosphor of each color. This results in exciting the phosphors to emit light, thus displaying an image.

More specifically, while successively selecting (applying the voltage to) the row-directional wires line by line, modulation signals for controlling the respective devices according to an input video signal are applied to the column-directional wires. The so-called line-sequential driving is carried out in this way. Therefore, the devices selected simultaneously are one device in each column-directional wire and at most 3000 devices in each row-directional wire. The reason why the row-directional wires are used as the wires successively selected line by line is that the time for selection can be longer in use of the smaller number of wires.

Figure 22:
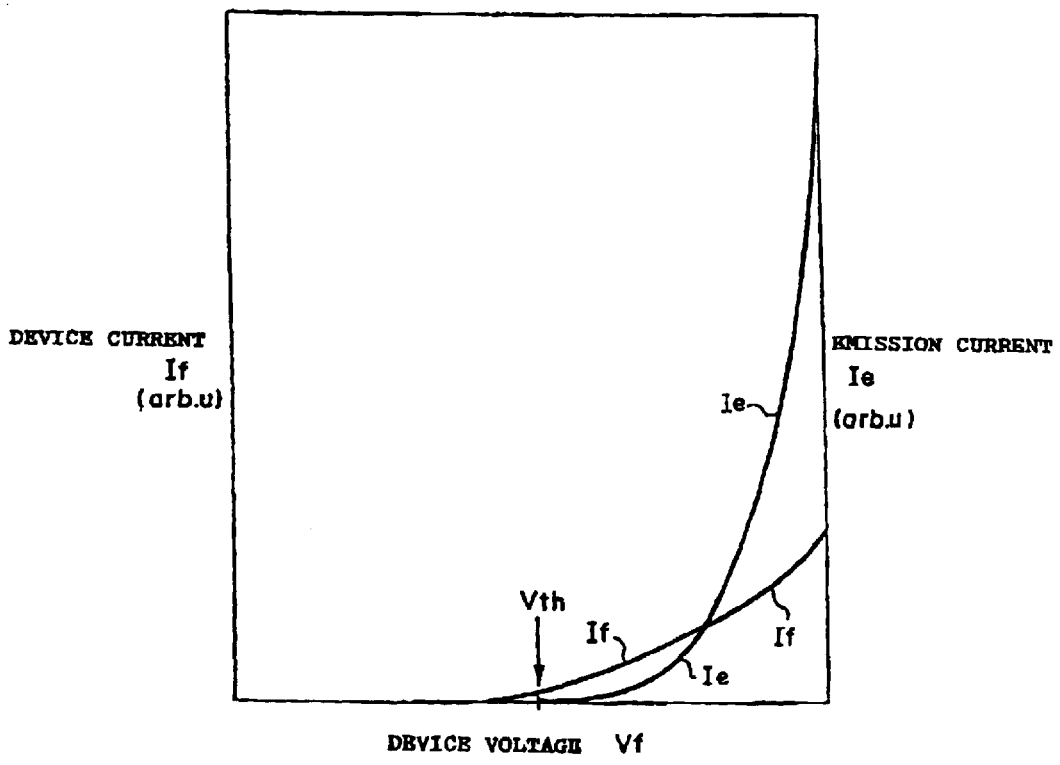
FIG. 22 is a schematic diagram to show the I-V (current-voltage) characteristics of the lateral type electron-emitting devices.

The above lateral electron-emitting devices emit electrons when the voltage is applied between the electrode 102 and the electrode 103. However, all electric current flowing in the electron-emitting region 105 does not turn into emission current. FIG. 22 schematically shows the relation between emission current (Ie) and device current (If) flowing between the electrodes against voltage (Vf) applied between the electrodes of the surface conduction type electron-emitting devices. At the same time as emission of electrons, ineffective current (If) appears flowing between the electrodes. This tendency is common to the lateral electron-emitting devices. In FIG. 22, Vth is a voltage at which the emission current Ie starts being measured.

In the image-forming apparatus of the present embodiment, since the lateral electron-emitting devices with If flowing as described above, are matrix-driven, more current flows to the row-directional wires to which more electron-emitting devices are connected on a common basis. Therefore, the resistance of the wires themselves needs to be set lower than that of the column-directional wires.

For the above reason, the resistance of the row-directional wires needs to be set lower than that of the column-directional wires. Specifically, the row-directional wires are preferably formed in the cross-sectional area larger than that of the column-directional wires.

A preferred method of increasing the cross-sectional area is to make the width of the row-directional wires wider than the width of the column-directional wires. In practice, however, increase in the width of the row-directional wires 106 results in decreasing the regions assigned to the electron-emitting devices and it is thus more preferable to meet the above condition by increasing the thickness of the row-directional wires. Namely, the thickness of the row-directional wires 106 is set thicker than the thickness of the column-directional wires 107.

On the other hand, the electrons emitted from the lateral electron-emitting devices are off the trajectory toward immediately above each electron-emitting region, as described previously. Namely, electrons fly with a shift toward the electrode to which a higher potential is applied, out of a pair of electrodes.

For this reason, the opposing direction of the pair of electrodes (the Y-direction in FIG. 13) is set in the same direction as the longitudinal direction of the thick row-directional wires 106. In other words, preferred setting is such that electrons fly with being deviated toward the column-directional wires 107 thinner than the row-directional wires. This setting can prevent the electrons emitted from the lateral electron-emitting devices from irradiating the thick row-directional wires and decreasing amounts of electrons reaching the anode (phosphors).

More detailed description will be given below about the driving of the above display panel with reference to FIG. 19.

Figure 19:
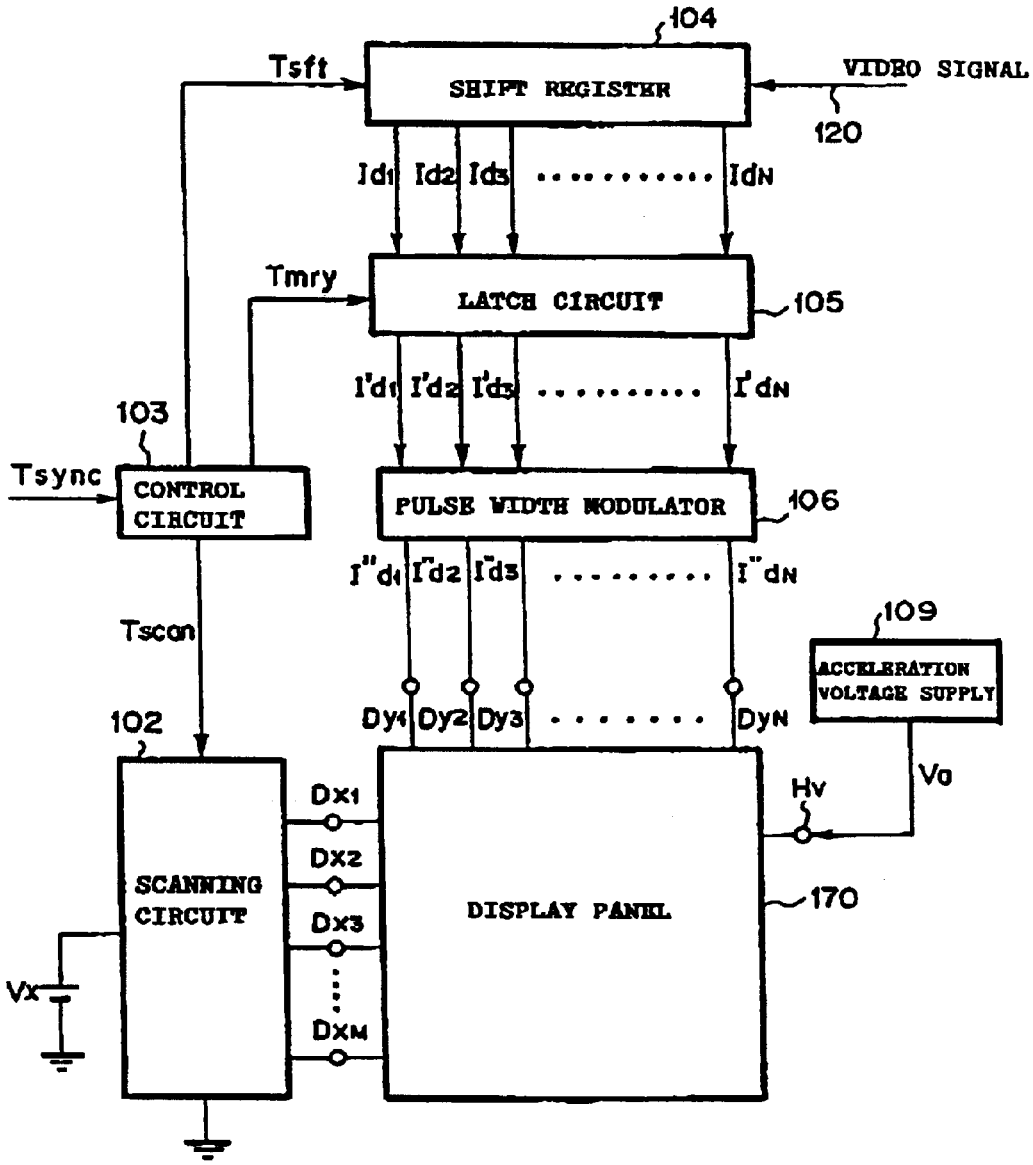
FIG. 19 is a block diagram of driving circuitry in the image-forming apparatus, which can be used in the present invention.

In FIG. 19, the display panel 170 corresponds to the envelope described above (see FIG. 17).

The display panel 170 is connected to external driving circuits through the row-directional wire terminals Dx1 to DxM connected to the row-directional wires 106 in the display panel 170 and through the column-directional wire terminals Dy1 to DyN similarly connected to the column-directional wires 107 in the display panel 170. Supplied to the row-directional wire terminals Dx1 to DxM out of the wires from a scanning circuit 102 are scanning signals for successively selecting and driving the multi-electron source provided in this display panel 170, i.e., the surface conduction type electron-emitting devices wired in the matrix pattern of M rows and N columns, line by line. On the other hand, supplied to the column-directional wire terminals Dy1 to DyN are modulation signals for controlling according to the input video signal, the electrons emitted from each device in a row of surface conduction type electron-emitting devices selected by each of the scanning signals applied from the scanning circuit 102 to the row-directional wires 106.

A control circuit 103 is a circuit having the function of matching operation timing of the respective sections so as to effect appropriate display based on the video signal supplied from the outside. There are two types of the video signal 120 supplied from the outside, a composite type of image data and synchronous signal, for example, as in NTSC signals, and a separate type wherein the two signals are preliminarily separated. The present embodiment will be described in the latter case. The former video signal can be similarly handled as in the present embodiment, in such a manner that the image data and the synchronous signal Tsync are separated by a well-known synchronous separator, the image data is supplied to a shift register 104, and the synchronous signal to the control circuit 103.

Here the control circuit 103 generates control signals of a horizontal synchronous signal Tscan, a latch signal Tmry, a shift signal Tsft, etc. for the respective sections, based on the synchronous signal Tsync supplied from the outside.

The image data (luminance data) included in the video signal from the outside is supplied to the shift register 104. This shift register 104 is a circuit for serial/parallel conversion of the image data serially supplied in time series in units of lines, which serially accepts and retains the image data in synchronism with the control signal (shift signal) Tsft supplied from the control circuit 103. The image data of one line after the conversion into parallel signals in this way in the shift register 104 (corresponding to driving data of N electron-emitting devices) is outputted as parallel signals Id1 to IdN to a latch circuit 105.

The latch circuits 105 is a storage circuit for storing and retaining the image data of one line for a required time, which stores the parallel signals Id1 to Idn in accordance with the control signal Tmry sent from the control circuit 103. The image data stored in the latch circuit 105 in this way is outputted as parallel signals I'd1 to I'dn to a pulse width modulation circuit 106. The pulse width modulation circuit 106 modulates these parallel signals I'd1 to I'dn into voltage signals pulse-width-modulated according to the image data (I'd1 to I'dn) by constant amplitude (voltage value) according thereto and outputs them as I"d1 to I"dn.

More specifically, this pulse width modulation circuit 106 is a circuit for outputting voltage pulses of wider pulse width with increase in the luminance level of the image data, which outputs, for example, voltage pulses with the pulse width of 30 $\mu$sec for the maximum luminance and the pulse width of 0.12 $\mu$sec for the minimum luminance and with the amplitude of 7.5 [V]. The output signals I"d1 to I"dn are applied to the column wire terminals Dy1 to DyN of the display panel 170.

The dc voltage Va, for example, of 5 kV is supplied from an acceleration voltage supply 109 to the high-voltage terminal Hv of the display panel 170.

Next, the scanning circuit 102 will be described below. This circuit 102 is provided with M switching devices inside and each switching device selects either the output voltage of the dc voltage supply Vx or 0 [V], (the ground level) to electrically connect it to the external terminal Dx1 to DxM of the display panel 170. The switching of these switching devices is carried out based on the control signal Tscan outputted from the control circuit 103 and they can be readily constructed by combination of switching devices, for example, such as FETs in practice. The dc voltage supply Vx is set to output a fixed voltage so that the driving voltage applied to the off-scan devices becomes not more than the electron emission threshold voltage Vth, based on the characteristics of the electron-emitting devices. The control circuit 103 functions to match operations of the respective sections so as to effect appropriate display based on the input image signal from the outside.

The shift register 104 and line memory 105 can be of either the digital signal type or the analog signal type. This is because the point is that the serial/parallel conversion and storage of the image signal is carried out at predetermined speed.

In the image display device of the present embodiment constructed in this structure, electron emission occurs when the voltage is applied through the external terminals Dx1 to Dxm, Dy1 to DyN to each electron-emitting device. Electron beams are accelerated by applying the high voltage through the high-voltage terminal Hv to the metal back 112 or to the transparent electrode (not illustrated). The accelerated wires collide with the fluorescent film 111 to induce emission of light, thereby forming an image.

The structure of the image display device described herein is just an example of the image-forming apparatus to which the present invention can be applied, and can be subject to various modifications based on the concept of the present invention. The input signal was of the NTSC system, but the input signal does not have to be limited to this; for example, it can be of the PAL or SECAM system or can be either of systems of TV signals consisting of much more scanning lines (high-definition TV systems including the MUSE system).

Figure 14:
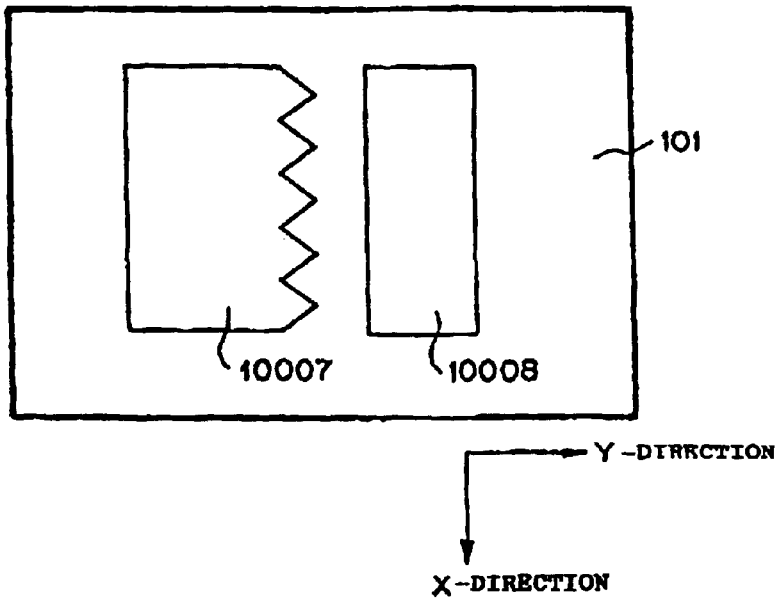
FIG. 14 is a plan view to show an example of lateral FE to which the present invention is preferably applicable.

The example herein was the apparatus wherein the electron-emitting devices were the surface conduction type electron-emitting devices, and, in addition thereto, the lateral FE devices illustrated in FIG. 14 can also preferably be applied. With use of the lateral FE devices, the aforementioned row-directional wires 106 and column-directional wires 107 can be connected to emitter electrodes 10007 and to gate electrodes 10008, respectively, each pair of which is a pair of electrodes of a lateral FE, as in the case of the pair of electrodes 102, 103 of the surface conduction type electron-emitting device. The opposing direction (the Y-direction) of the emitter electrode 10007 and the gate electrode 10008 is preferably equal to the longitudinal direction of the row-directional wires 106, as described previously.

Next, an example of the production method of the image-forming apparatus using the surface conduction type electron-emitting devices illustrated in FIG. 13 and FIG. 17 will be described below.

First, the production steps of the rear plate 101 will be described referring to FIG. 8.

(1) The rear plate 101 is cleaned well with detergent, pure water, and an organic solvent and thereafter the material of the electrodes 102, 103 is deposited. The deposition method can be either of vacuum deposition techniques, for example, such as evaporation or sputtering. After that, the deposited electrode material is patterned by photolithography and etching technology to form the paired electrodes 102, 103 illustrated in FIG. 8(*a*).

The example herein is the case using the photolithography technology, but it is preferable to use the offset printing method in order to accurately and readily make the electrodes in large area and at low cost.

Figure 8:
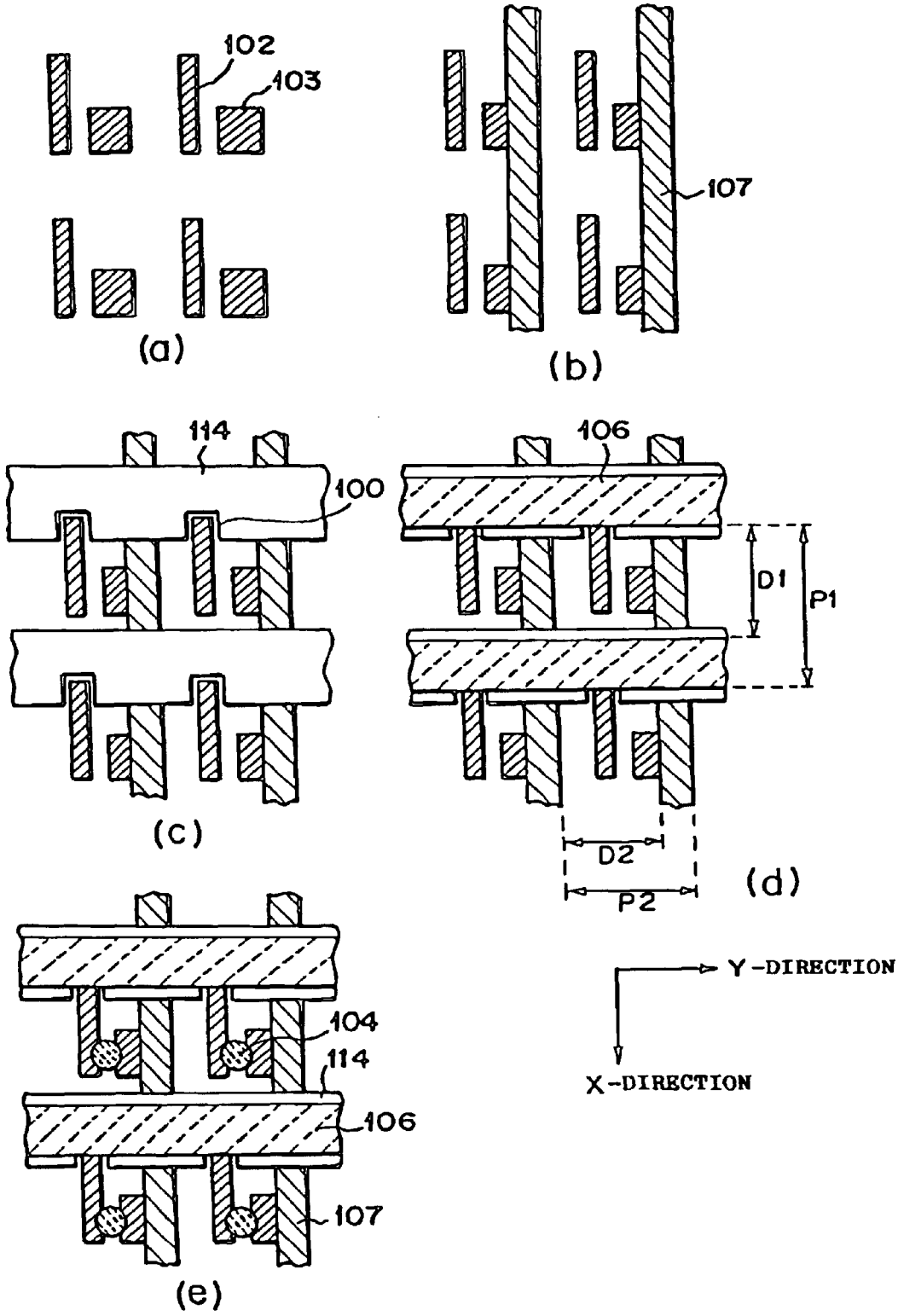
FIG. 8 is a diagram to show an example of production steps of an electron source substrate.
Figure 9:
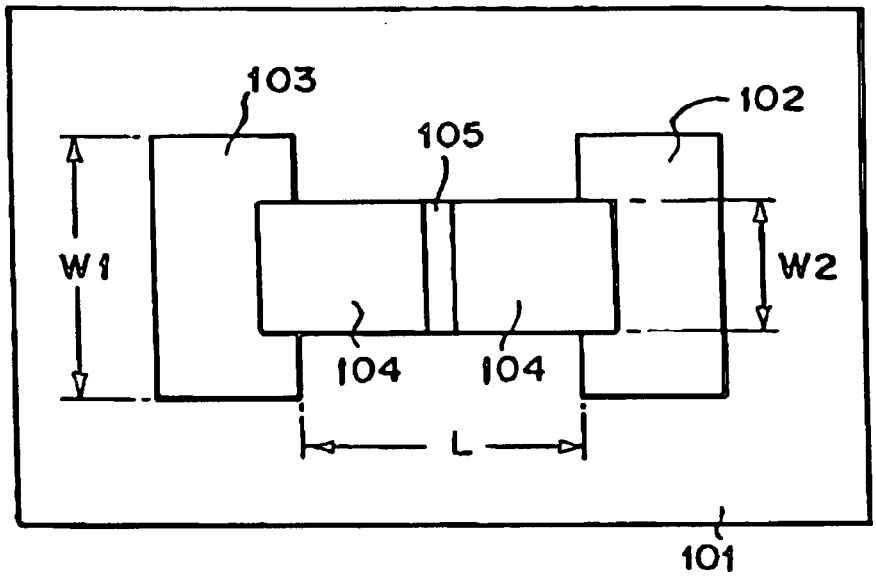
FIG. 9 is a plan view to show the structure of the surface conduction type electron-emitting device.

(2) Then the column-directional wires 107 are formed so as to cover part of one-side electrodes 103, as illustrated in FIG. 8(*b*).

Specifically, the photosensitive, electroconductive paste (ink containing at least the photosensitive material and the electroconductive material for the wires) is applied onto the entire surface on the rear plate 101 with the electrodes formed thereon in the above step (1). Then the applied paste is dried and thereafter the paste is exposed to light with a mask having apertures in the pattern of the column-directional wires 107 illustrated in FIG. 8 (*b*). Then the paste in non-exposed regions is selectively removed (developed) with a solvent or the like. After that, the paste remaining on the rear plate 101 is baked to remove the photosensitive material and excess organic substances, thereby forming the column-directional wires 107.

Presented herein is the example wherein the photosensitive, electroconductive paste is applied to the entire surface of the substrate 101. When the photosensitive, electroconductive paste is applied onto the entire surface of the rear plate 101, it, however, contaminates the gaps between the electrodes 102, 103 for formation of the electroconductive films 104. Some residues remaining in the gaps between the electrodes, depending upon the materials contained in the photosensitive, conductive paste, can negatively affect the electron emission characteristics or cause trouble in the production steps (for example, in the forming step) of the electron-emitting regions 105 in certain cases, because the thickness of the conductive films 104 is very thin, etc.

This problem is not one caused by only the difference between the pitch of the column-directional wires and the pitch of the row-directional wires described previously and the beam shape specific to the lateral wire-emitting devices. It is the problem specific to the image-forming apparatus using the surface conduction type electron-emitting devices necessitating a very thin, conductive film between each pair of electrodes.

Therefore, it is necessary to conduct sufficient cleaning on the occasion of removal of the photosensitive, conductive paste in the unnecessary portions, or after the removal in the case wherein the photosensitive, conductive paste is applied onto the entire surface on the substrate 101, as described above.

Figure 15:
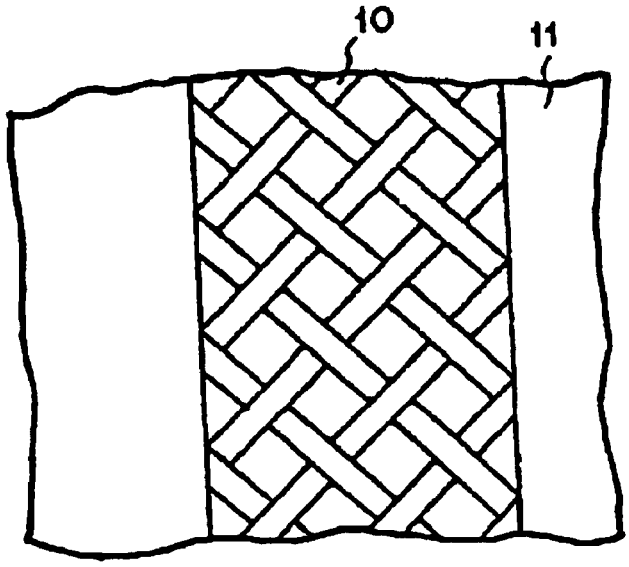
FIG. 15 is a schematic diagram of the plate (mask) used in screen printing.
Figure 16:
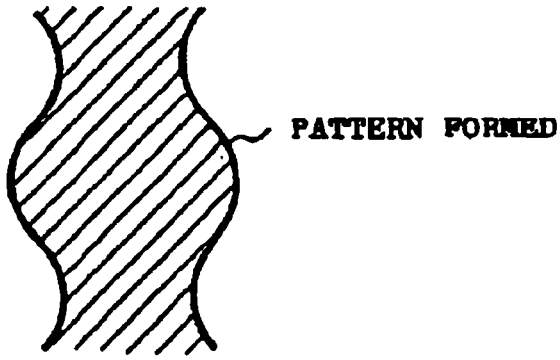
FIG. 16 is a schematic diagram of the pattern formed in screen printing.

In order to preferably restrain the contamination in the gap portions between the electrodes 102, 103, it is thus preferable to apply the photosensitive, conductive paste in a rough pattern (first pattern) at desired portions through apertures of a mask having the apertures corresponding to a desired pattern, dry the paste, and thereafter carry out the aforementioned exposure/development/baking, thereby finally forming a desired pattern (second pattern). Specifically, a preferred method is a method of forming a coating of the rough pattern (first pattern) on the rear plate 101 through the apertures of the screen plate as illustrated in FIG. 15, by the screen printing method, drying it, and effecting exposure and development to obtain the desired pattern (second pattern). Any other method can also be adopted as long as the first pattern (rough pattern) described above can be formed.

This method can restrain the aforementioned contamination in the gap portions between the electrodes 102, 103 due to the photosensitive, conductive paste and reduce a waste amount of the expensive, photosensitive, conductive paste in the development (removal of the unnecessary, photosensitive, conductive paste). For forming the wires for driving of the surface conduction type electron-emitting devices with the photosensitive, conductive paste, it is thus preferable to apply the photosensitive, conductive paste in a desired shape (first pattern) at desired portions through apertures of a mask having the apertures corresponding to a desired pattern, dry it, and thereafter carry out the aforementioned exposure/development/baking, thereby finally obtaining a desired pattern (second pattern).

With consideration to the purpose of reducing the waste amount of the photosensitive, conductive paste in the above development, the column-directional wires 107 of the desired pattern (second pattern) can not be formed only by the above coating method of the photosensitive, conductive paste with the mask, but can also be formed, for example, by a method of applying the photosensitive, conductive paste onto the entire surface of the substrate 101, thereafter pushing a mold having the first pattern against the photosensitive, conductive paste thus applied to form the first pattern, drying it, and thereafter carrying out the exposure/development/baking, thereby forming the column-directional wires 107 in the desired pattern (second pattern).

The photosensitive, conductive paste before the drying was called the first pattern herein, but the first pattern in the present invention means the pattern of the photosensitive, conductive paste formed on the rear plate 101 before the development. Namely, the first pattern is the pattern rougher (larger in volume or wider in width) than the pattern expected to obtain finally.

The example herein was the case wherein the photosensitive, conductive paste was the so-called negative type (which becomes insoluble to a specific solvent after exposed to light), but it can also be the so-called positive type (which becomes soluble to a specific solvent after exposed to light) on the other hand.

In the present invention, the photosensitive, electroconductive paste is a paste containing at least particles of the electroconductive material with the average particle size of 0.1 to 5 $\mu$m, preferably, 0.3 to 1 $\mu$m, and the material with photosensitivity and having fluidity. The ultraviolet light is particularly preferable as the light for irradiating the photosensitive, conductive paste.

The photosensitive material can be, for example, a photosensitive polymer. More specifically, the photosensitive, conductive paste of the aforementioned negative type can be one of optically insolubilized photosensitive polymers. On the other hand, the paste of the positive type can be one of optically solubilized photosensitive polymers.

The conductive material can be selected preferably, for example, from the aforementioned metals of Ag, Au, Pt, etc. suitable for the wire materials and is more preferably particles thereof.

The above photosensitive polymer can be, for example, an acrylic copolymer having the carboxyl group and ethylenically unsaturated group in side chains. This material can be produced, for example, by adding side chains of the ethylenically unsaturated group to the acrylic copolymer formed by copolymerization of unsaturated carboxylic acid and ethylenically unsaturated compound.

The above photosensitive, conductive paste may further contain a photoreactive compound, a photopolymerization initiator, glass frit (glass particles), a metallic oxide, a sensitizer, etc. as occasion may demand.

Since in the present invention the rear plate is preferably made of glass, it is particularly preferable to make coefficients of thermal expansion of the wires and the rear plate close to each other, adjust the baking temperature of the paste, and add the glass frit in order to enhance adhesion between the metal particles and the rear plate.

The glass frit can be, for example, one containing $SiO_2$, $ZrO_2$, $B_2O_3$, and $LiO_2$ each 1 to 50 wt %. Since the glass frit is electrically insulative, it is, however, preferably contained 10 or less wt % over the paste.

Further, it is preferable to add the metallic oxide, because it has the effect as a sintering assistant, e.g., to restrain abnormal growth of particles of the conductive material. However, it is preferably added in a small amount, because it is basically an electric insulator.

(3) Then the insulating layers 114 are formed at the intersecting portions between the column-directional wires 107 and the row-directional wires 106 to be made in the next step (FIG. 8(*c*)). When the shape of the insulating layers is the continuous form, for example, the comb-teeth shape as illustrated in FIG. 8(*c*), it can decrease the level difference (the sum of the thickness of the column-directional wire 107 and the thickness of the insulating layer 114) which the row-directional wires should get over at the intersecting portions with the column-directional wires. Further, it can make connection easier with the electrodes 102, because part of the electrodes 102 are covered at the depressions 100 of the insulating layers 114. The shape of the insulating layers 114 does not have to be limited to that illustrated in FIG. 8, but the insulating layers 114 may also be formed discretely only at the aforementioned intersecting portions.

There are no specific restrictions on the method of forming the insulating layers 114, but it is desirable to form them by the screen printing method in terms of assurance of good electric insulation and low cost.

Further, it is also preferable to make the insulating layers 114 of the photosensitive paste, as in the case of the column-directional wires, because some precision is necessary for the locations thereof. With use of the photosensitive paste, it is particularly desirable to form a rough pattern (first pattern) by the screen printing method and thereafter effecting exposure and development to obtain the desired pattern (second pattern), as in the case of the column-directional wires.

However, the photosensitive paste used herein is an electrically insulative paste and an insulating material such as glass particles or the like is added thereto instead of the particles of the conductive material contained in the aforementioned photosensitive, conductive paste.

(4) Next, the row-directional wires 106 are made (FIG. 8(*d*)). In the present invention the pitch P1 of the row-directional wires 106 is larger than the pitch P2 of the column-directional wires 107. Further, the distance D1 of the row-directional wires 101 is greater than the distance D2 of the column-directional wires 107.

There are no specific restrictions on the method of forming the row-directional wires 106, either, but it is desirable to form them by the screen printing method in consideration of low cost.

Further, it is also preferable to make the row-directional wires 106 of the photosensitive, electroconductive paste in terms of accuracy, as in the case of the column-directional wires. With use of the photosensitive, conductive paste, taking the aforementioned contamination in the gap portions between the electrodes into consideration, it is particularly desirable to form a rough pattern (first pattern) by the screen printing method and thereafter performing exposure and development to obtain the desired pattern (second pattern), as in the case of the column-directional wires.

On the other hand, the row-directional wires 106 need to have the resistance lower than that of the column-directional wires, as described previously, because the scanning signals are applied thereto. For this reason, the thickness of the row-directional wires is thicker than that of the column-directional wires in order to form the display image in higher definition. Therefore, the row-directional wires 106 are laid through the insulating layers 114 above the column-directional wires 107 at the intersections between the row-directional wires 106 and the column-directional wires 107. This is because the possibility of discontinuity at the intersections can be lower where the row-directional wires 106 get over the laminate of the column-directional wire 107 and the insulating layer 114 then where the column-directional wires 107 get over the laminate of the row-directional wire 106 and the insulating layer 114.

For the above reason, the row-directional wires are laid through the insulating layers 114 above the column-directional wires 107 in the image-forming apparatus of the present invention.

Therefore, the row-directional wires 106 are exposed in very large area to the vacuum inside the image-forming apparatus. Particularly, in the case of the image-forming apparatus using the surface conduction type electron-emitting devices or the lateral FE, the high voltage is applied to the acceleration electrode such as the metal back located opposite to the wires. For this reason, the wires are exposed to a very strong electric field. Therefore, the preferred shape of the row-directional wires 106 having the large exposed area is a form as round as possible. From this point of view, it is preferable to make the row-directional wires 106 by selectively applying a non-photosensitive, conductive paste by the screen printing method and baking it, without using the method involving exposure and development with the photosensitive, conductive paste.

(5) Then the conductive films 104 are formed between each pair of electrodes 102, 103. A preferred method of forming the conductive films 104 is the ink jet method capable of readily forming the conductive films in large area and at low cost. Specifically, the conductive films 104 are made by applying droplets of the aforementioned material for formation of the conductive films onto between the electrodes 102, 103 by use of the device illustrated in FIG. 7 and baking them (FIG. 8(*e*)).

(6) Then the FORMING process is carried out. An appropriate voltage is applied between each pair of electrodes 102 and 103 to allow electric current to flow in the conductive films, thereby forming a gap in part of the conductive films. If an activation process described hereinafter is not carried out, the gaps made by this FORMING process and the surroundings thereof compose the electron-emitting regions 105.

(7) Next, preferably, the activation process is carried out. The activation process is a process of applying an appropriate voltage between the electrodes 102 and 103 in an atmosphere containing a carbon compound, so as to improve the electron emission characteristics. This activation process is a process of depositing carbon or the carbon compound on the substrate 101 inside the gaps formed by the above FORMING process, and on the conductive films 104 near the gaps. This step results in forming second gaps of carbon films in the first gaps formed in the aforementioned FORMING step. The second gaps are narrower than the first gaps. The activation process can increase the emission current at the same applied voltage, as compared with that before the activation.

More specifically, voltage pulses are periodically applied in a vacuum atmosphere with the organic substance introduced in the range of about $10^{-3}$ to $10^{-6}$ [torr] ($1.33\times10^{-1}$ to $1.33\times10^{-6}$ [Pa]) to deposit carbon or the carbon compound originating in the organic compound existing in the atmosphere.

Through the above steps, the rear plate (electron source substrate) 101 with the surface conduction type wire-emitting devices is obtained.

Described next are the steps of producing the face plate.

(8) First, the face plate 110 is cleaned well with detergent, pure water, and an organic solvent and thereafter the black member (black matrix) with a plurality of apertures for placement of the phosphors is formed, as illustrated in FIG. 12, on the face plate substrate 110. The black member is a material mainly containing graphite, for example, but is not limited to this. The black member herein is formed in the grid shape as illustrated in FIG. 12, by the printing method or by the photolithography process. The pattern of the black member may also be the stripe shape illustrated in FIG. 18, as stated previously.

The shape of the apertures (the areas for formation of the phosphors) of the black member is rectangular. In FIG. 12, the Y-directional pitch of the phosphors of the different colors is set smaller than the X-directional pitch of the phosphorus of the same color.

(9) Then the phosphors of red, blue, and green are disposed each in the predetermined apertures of the black member by the screen printing method or the like. The phosphors are disposed, for example, by applying a paste consisting of a mixture of phosphor particles and a resin, such as polymethacrylate-based, cellulose-based, or acrylic-based resin, dissolved in an organic solvent, by the screen printing method or the like and drying it.

(10) Further, a filming layer is formed on the phosphors and black member. A material of the filming layer is, for example, one obtained by dissolving resin, such as the polymethacrylate-based, cellulose-based, or acrylic-based resin, in an organic solvent, and it is applied by the screen printing method or the like and dried.

(11) Then a metal film (Al) is deposited on the filming layer by evaporation or the like.

(12) After that, the face plate is heated to remove the resin included in the phosphor paste and, the filming layer, thereby obtaining the face plate with the phosphors, the black member, and the metal back formed thereon.

(13) The spacers 20 and the outer frame 109 are placed and positioned between the face plate produced as described above and the rear plate with the electron-emitting devices etc. formed thereon.

Then the members are bonded to each other by heating the adhesive member placed on the joint parts of the outer frame, the face plate, and the rear plate, thereby obtaining the envelope (display panel) 170 illustrated in FIG. 17.

The above sealing is preferably carried out in a vacuum chamber, so as to perform the bonding and the sealing at the same time.

The present invention will be described below with embodiments thereof in order to explain it in more detail.

[Embodiment 1]

In the present embodiment, the flat panel display was formed using the surface conduction electron-emitting devices. The production method of the display of the present embodiment will be described below referring to FIG. 17, FIG. 8, FIG. 12, and FIG. 13.

(1) The rear plate 101 was prepared by forming $SiO_2$ in the thickness of 0.5 $\mu$m on the surface of soda lime glass by sputtering.

(2) The paired electrodes 102, 103 were formed in 1000 sets in the X-direction and 5000 sets in the Y-direction on the surface of $SiO_2$ (FIG. 8(*a*)). It is noted here that FIG. 8 shows only two sets in the X-direction and two sets in the Y-direction, totally four sets of electron-emitting devices, for simplicity of description.

In the present embodiment, the material of the electrodes was Pt. The electrodes 102, 103 were made by the offset printing method. The gaps between the electrodes 102 and the electrodes 103 were 20 $\mu$m.

(3) The photosensitive, electroconductive paste of the negative type was applied onto the entire surface on the rear plate 101 with the electrodes 102, 103 formed thereon. The photosensitive, conductive paste used in the present embodiment was the one obtained by mixing spherical Ag particles as the conductive material and an acrylic resin as the photosensitive member to be cured by reaction to ultraviolet light and further adding a glass filler or the like thereto.

(4) After than, the photosensitive, conductive paste was dried and the photosensitive, conductive paste thus dried was irradiated with (or exposed to) the ultraviolet light with a shield mask having a plurality of stripe apertures. Then the rear plate was washed with an organic solvent to remove unexposed portions (to effect development).

(5) Further, the rear plate was baked to form 5000 column-directional wires 107 in the width of 50 $\mu$m and at the pitch of 180 $\mu$m (FIG. 8(*b*)). After this step, the column-directional wires 107 covered part of the electrodes 103, so that the electrodes 103 were connected to the column-directional wires 107.

(6) The paste containing the glass binder and resin was applied in the comb-teeth-shaped pattern illustrated in FIG. 8(*c*), by the screen printing method and baked to form 1000 insulating layers 114.

(7) The paste containing the Ag particles, glass binder, and resin was applied in the line pattern illustrated in FIG. 8(*d*), by the screen printing method and baked to form 1000 row-directional wires 106. After this step, the row-directional wires 106 covered part of the electrodes 102, so that the electrodes 102 were connected to the row-directional wires 106. The row-directional wires 106 were formed in the width of 150 $\mu$m and at the pitch P1 of 500 $\mu$m.

In the display of the present embodiment, the spacers 20 were placed as illustrated in FIG. 17. The spacers are set in contact with the row-directional wires, so as to electrically connect the row-directional wires 106 to the metal back 112. Therefore, the width of the row-directional wires 106 is set greater than that of the column-directional wires 107, also taking it into consideration to assure the areas for sufficient contact with the spacers in assembly of the display.

(8) Then the ink containing Pd was applied onto all the gap portions between the electrodes 102 and the electrodes 103. Then the ink was baked at 350° C. in the atmosphere to form the conductive films 104 of PdO (FIG. 8(*e*)).

In the present embodiment, an ink jet device of the piezo method being one of the ink jet methods was used for the above application of ink. In the present embodiment the ink containing Pd was an aqueous solution of an organo-Pd compound: 0.15%, isopropyl alcohol: 15%, ethylene glycol: 1%, and polyvinyl alcohol: 0.05%.

The electron source substrate (rear plate) before FORMING was formed through the above steps.

(9) The electron source substrate before forming prepared through the above-stated steps was placed in a vacuum chamber, the inside of the chamber was evacuated down to $10^{-4}$ Pa, thereafter hydrogen was introduced thereinto, and in that state the "FORMING step" of applying the pulsed voltage to each of the column-directional wires 107 and row-directional wires 106 was carried out. This step caused electric current to flow in each conductive film 104, whereby a gap was formed in part of each conductive film 104. In the FORMING step pulses of the constant voltage of 5 V were repetitively applied. The pulses were triangular waves of voltage waveforms having the pulse width and the pulse interval of 1 msec and 10 msec, respectively. The energization forming process was terminated when the resistance of the conductive film became not less than 1 MΩ.

(10) The devices after completion of the FORMING step were subjected to the process called the activation step. The inside of the chamber was evacuated down to $10^{-6}$ Pa, thereafter benzonitrile was introduced to $1.3\times10^{-4}$ Pa, and the "activation step" of applying the pulsed voltage to each of the column-directional wires 107 and row-directional wires 106 was carried out. By this step, the carbon films were formed inside the gaps formed by the above FORMING and on the conductive films 104 near the gaps, thus obtaining the electron-emitting regions 105. In the activation step, the pulsed voltage of rectangular waves having the pulse peak height of 15 V, the pulse width of 1 msec, and the pulse separation of 10 msec was applied to each device.

The rear plate with the electron-emitting devices placed thereon was produced through the above steps. FIG. 13 shows an enlarged view of part of the rear plate.

Next, the method of producing the face plate will be described.

(11) First, the face plate substrate 110 of the same material as the rear plate was cleaned and dried well. After that, the black member was formed in the pattern illustrated in FIG. 12 on the substrate 110 by the photolithography process. The black member herein was formed in the grid pattern with the apertures corresponding to the portions for the locations of the respective color phosphors. The Y-directional pitch of the black member was equal to the pitch of the column-directional wires and the X-directional pitch thereof was equal to the pitch of the row-directional wires.

(12) The phosphors of the respective colors were formed in the array illustrated in FIG. 12 in the apertures of the black member by the screen printing method.

(13) Further, the filming layer was formed on the black member and phosphors. The material of the filming layer was one obtained by dissolving the polymethacrylate-based resin in the organic solvent, and it was applied by the screen printing method, and then dried.

(11) Then Al was deposited on the filming layer by evaporation.

(12) After than, the face plate was baked to remove the resin contained in the phosphor paste and, the filming layer, thus obtaining the face plate with the phosphors, black member, and metal back formed thereon.

(13) The spacers 20 with a high-resistance film on the surface and the outer frame 109 preliminarily coated with the adhesive member were placed between the rear plate and the face plate formed through the above steps. Then they were heated and pressed in vacuum in a state in which the face plate was aligned well with the rear plate, whereby the adhesive member was softened to bond the members to each other. Through this sealing step, the envelope 170 illustrated in FIG. 17 was obtained while the inside was maintained in high vacuum. The high-resistance film provided on the surface of the spacers was provided for leading the charge accumulated in the spacer surface because of irradiation of the spacer surface with electrons, to the row-directional wires or to the metal back.

For this placement of the spacers, the pattern of the black member is preferably the grid pattern illustrated in FIG. 12 rather than the stripe pattern illustrated in FIG. 18. The reason will be described below.

The metal back to which the spacers are electrically connected is a very thin film. For this reason, if in the contact portions with the spacers there exist the phosphors being the aggregate of particles below the metal back, there will be cases wherein sufficient electric connection is not established between the spacers and the metal back, or cases wherein contact with the spacer can cause peeling of the phosphor particles or the metal back so as to cause discharge between the cathode and the anode. It is thus preferable to provide the relatively flat black member with stronger adhesion to the face plate substrate 110 than the phosphor particles, in the contact portions with the spacers. Further, it is also preferable to place the black member in the grid pattern from the viewpoint of enhancing the contrast.

The reason why the spacers are in contact with the row-directional wires (the wires to which the scanning signals are applied) is that they are prevented from interrupting the trajectories of the electron beams emitted from the lateral electron-emitting devices. A further reason is easiness in alignment with the spacers.

The display panel 170 obtained as described above was connected to the driving circuit illustrated in FIG. 19 and a dynamic picture was displayed thereon by line-sequential scanning.

In the present embodiment, the scanning signals were applied to the row-directional wires 106 having the larger cross-sectional area of wire, and the modulation signals to the column-directional wires 107.

When the moving image was displayed in this way, images with very high definition and high luminance were able to be observed over a long period. There was no pixel defect observed. One of the reasons is conceivably that the column-directional wires 107 were made of the photosensitive, conductive paste, so as to restrain the soaking of droplets of the precursor for the conductive films 104 applied by the ink jet method, and the column-directional wires were able to be formed in very high density.

[Embodiment 2]

In the present embodiment the method of forming the column-directional wires 107 is different from that in Embodiment 1.

The following will describe the method of forming the column-directional wires in the present embodiment. Since the members other than the column-directional wires were made in the same manner as in Embodiment 1, the description thereof will be omitted herein.

Figure 1:
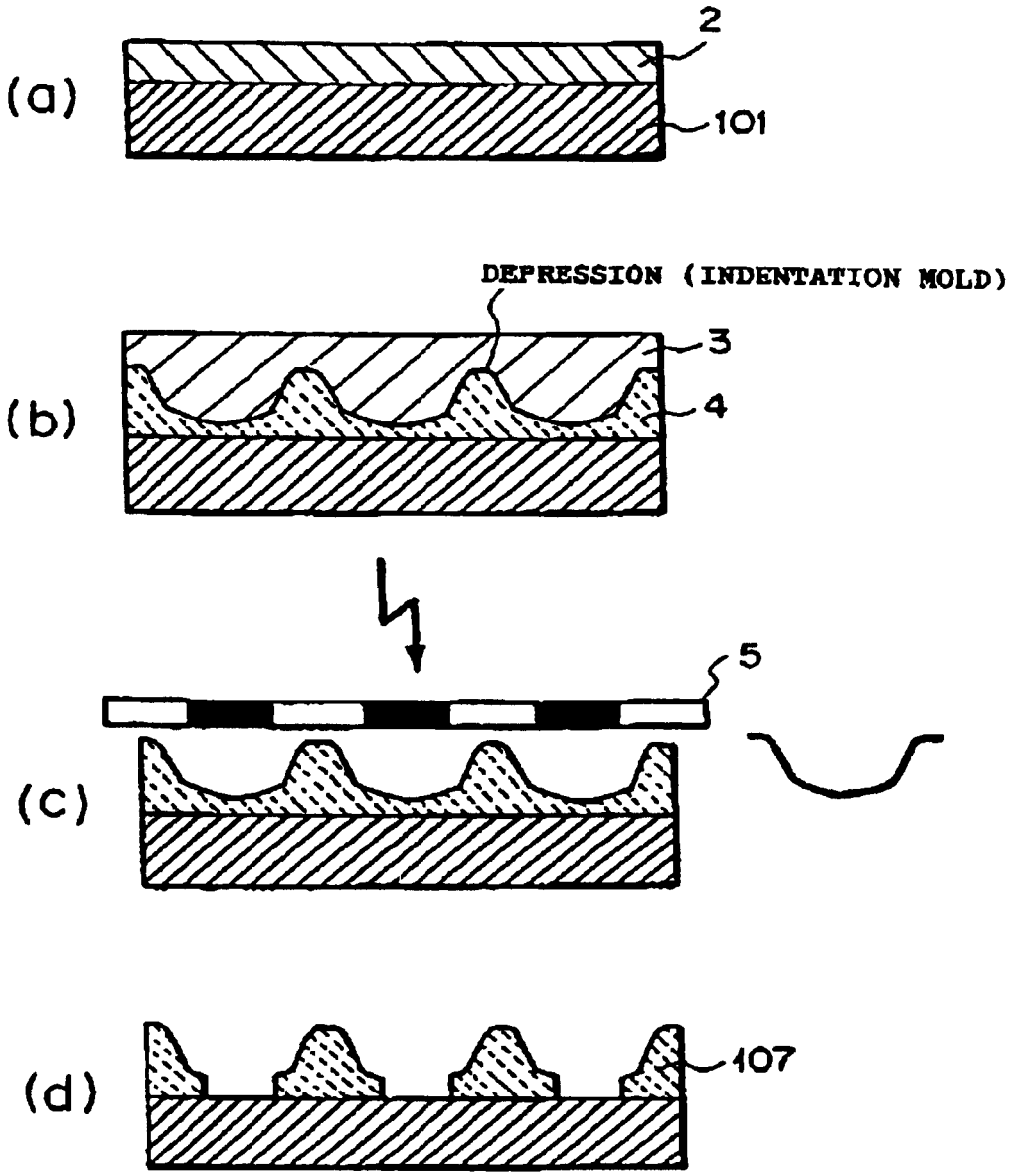
FIG. 1 is a drawing to show an example of steps in the production method of the present invention.

The present embodiment will be described referring to FIG. 1. FIG. 1 is a diagram to illustrate the process of producing the column-directional wire pattern in Embodiment 2.

In the present embodiment, the photosensitive, conductive paste containing the Ag particles, similar to the photosensitive, conductive paste used in Embodiment 1, was applied in the thickness of 20 $\mu$m onto the entire surface on the rear plate 101 having the electrodes 102, 103 formed in (1) and (2) of Embodiment 1.

After that, the above photosensitive, conductive paste layer 2 was dried by carrying out infrared drying at the surface temperature of 100° C. for several minutes (FIG. 1(*a*)).

Then a mold 3 having depressions 15 $\mu$m deep was placed on the photosensitive, conductive paste layer 2 and the mold 3 was pushed against the photosensitive, conductive paste layer 2 by a press machine to form the rough pattern (first pattern) 4, as illustrated in FIG. 1(*b*).

The mold may have any shape if the paste can readily be filled into the depressions of the mold during the pushing step thereof into the paste layer. The depth of the depressions is preferably greater then the height of the pattern expected to obtain finally, from the substrate. The material for the mold can be either of metal, glass, resin, and so on.

After eliminating the mold 3, the pattern was exposed to UV light of $\lambda$=350 nm under the condition of 250 mJ per $cm^2$ with a flat plate glass photomask 5, as illustrated in FIG. 1(*c*). Since the photosensitive, conductive paste used in the present embodiment was the negative type, the photomask had the pattern for intercepting the light in the bottom portions from which the paste was expected to be removed.

After this, the paste was developed and baked under the condition of holding it at 550° C. for ten minutes. Through these steps, the pattern of the column-directional wires 107 was obtained in the predetermined thickness, as illustrated in FIG. 1(*d*).

The present embodiment was able to decrease the waste amount of the paste to the minimum in the development of the photosensitive, conductive paste, as compared with the production method of Embodiment 1.

[Embodiment 3]

In the present embodiment the mold used was one pushed against the flat film of the photosensitive, conductive paste and also serving as a mask during exposure. The column-directional wires 107 were formed in the same manner as in Embodiment 2, except for this.

Figure 2:
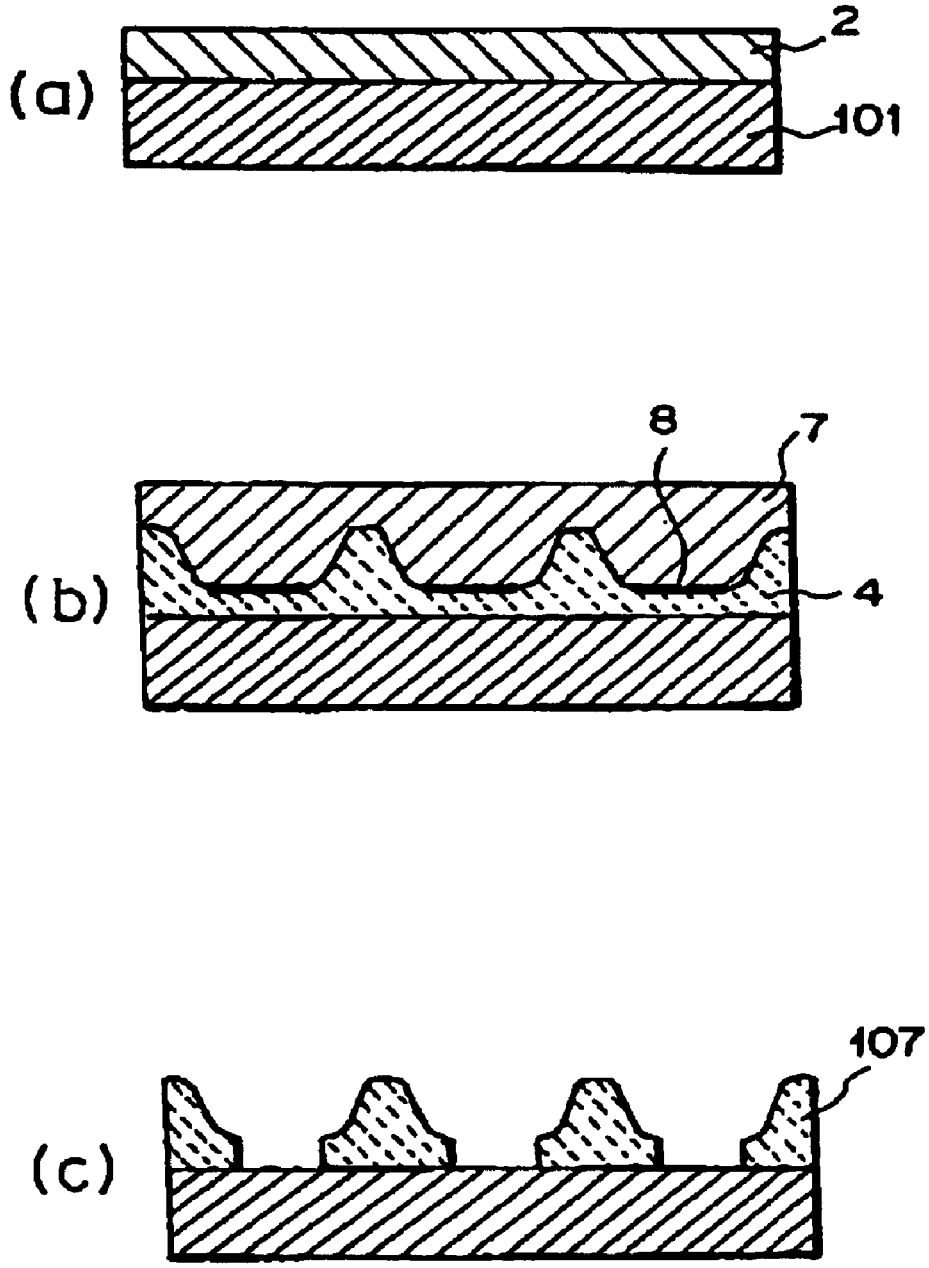
FIG. 2 is a drawing to show another example of steps in the production method of the present invention.

The present embodiment will be described below referring to FIG. 2. FIG. 2 is a diagram to illustrate the production process of Embodiment 3.

First, the photosensitive, conductive paste layer 2 used in Embodiment 1 was deposited in the thickness of 20 $\mu$m over the entire surface on the rear plate 101 with the electrodes 102, 103 formed thereon (FIG. 2 (*a*)), as in Embodiment 2.

After that, the rough pattern (first pattern) 4 was formed using the mold 7 with a shield pattern 8 also serving as a mask, as illustrated in FIG. 2(*b*).

In the present embodiment the paste layer was exposed under the same condition as in Embodiment 2 and in a pressed state of the mold 7 also serving as a mask, as illustrated in FIG. 2(*b*). Since the photosensitive, conductive paste used in the present embodiment was the negative type, the mold 7 also serving as a mask had the pattern for intercepting the light in the bottom portions expected to be removed.

After this, the paste layer was developed and baked as in Embodiment 2, thereby obtaining the column-directional wires 107 having the predetermined pattern as illustrated in FIG. 2(*c*).

As a result, the present embodiment was able to decrease the waste amount of the photosensitive, conductive paste wasted in the development.

Figure 6:
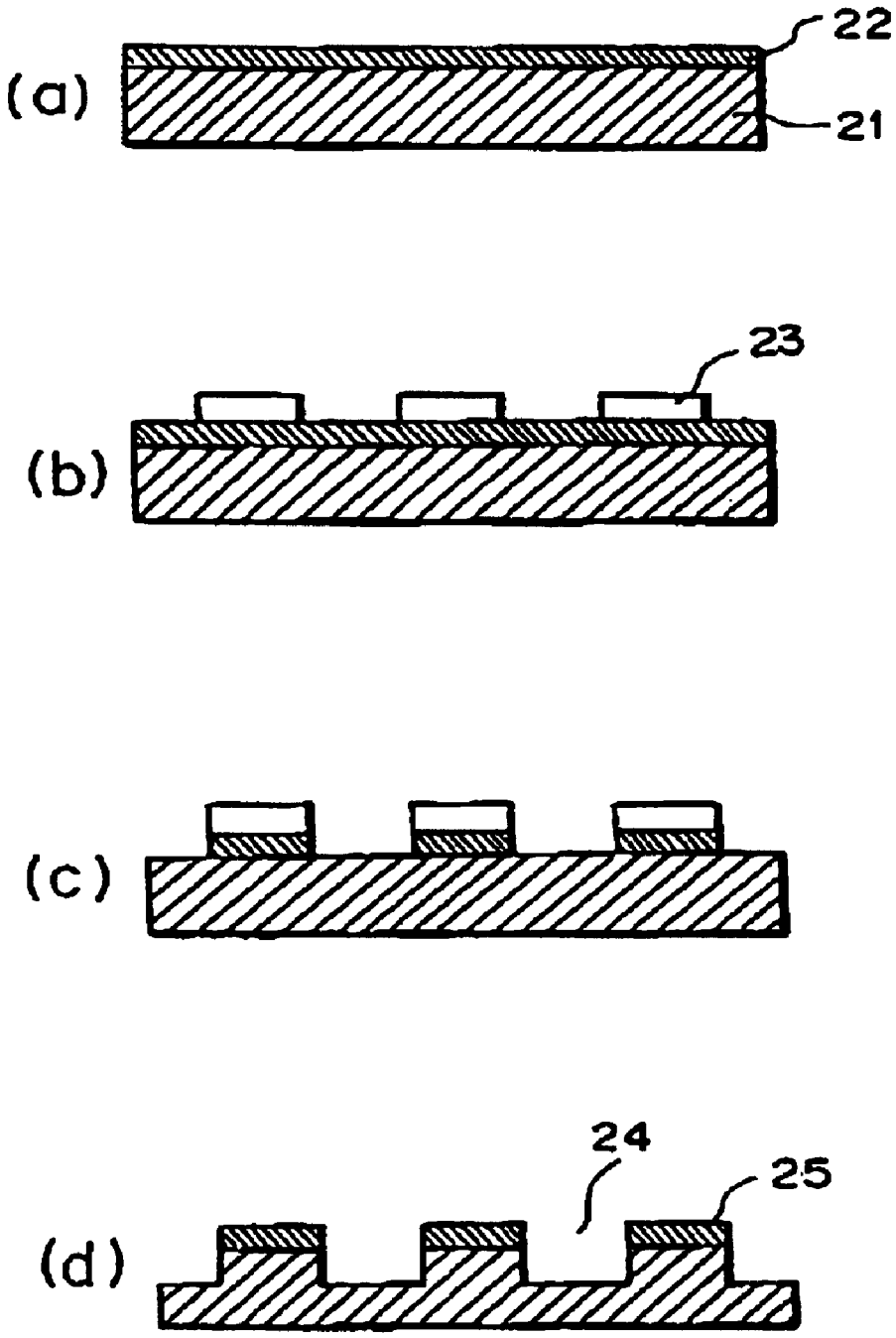
FIG. 6 is a step diagram of a production method with a mold also serving as a mask in the present invention.

FIG. 6 shows an example of a fabrication method of the mold also serving as a mask, which can be applied in the present invention.

First, a thin metal film 22 is formed on a glass substrate 21 by sputtering, as illustrated in FIG. 6(*a*).

Then a resist film 23 is formed as flat film over the entire surface of the metal film by a spin coating method and the resist film 23 is patterned by photolithography or the like, as illustrated in FIG. 6(*b*).

Then the metal film 22 is etched as illustrated in FIG. 6(*c*). Finally, exposed glass portions are etched with hydrofluoric acid or the like to form depressions 24 and projections 25, as illustrated in FIG. 6(*d*). After that, the resist 23 is removed to obtain the mold also serving as a mask.

Here the metal film left in FIG. 6(*d*) functions to intercept the light.

[Embodiment 4]

In the present embodiment, the photomask used during the exposure was a fluid containing a mixture of alcohol and pigment, as a light-intercepting fluid. The column-directional wires 107 were formed in the same manner as in Embodiment 2, except for this.

Figure 3:
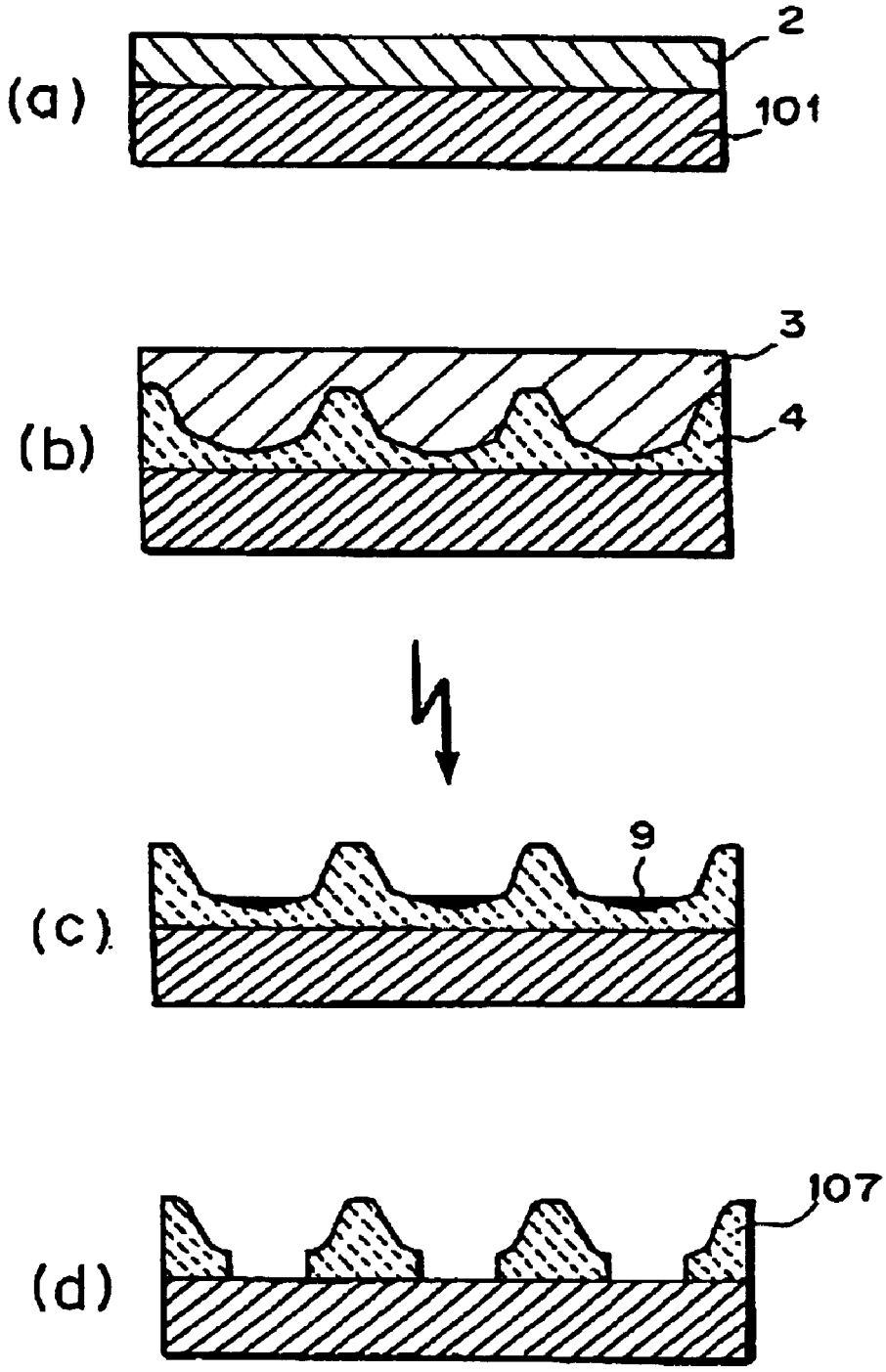
FIG. 3 is a drawing to show another example of steps in the production method of the present invention.

FIG. 3 is a diagram to explain the production process of the column-directional wires 107 in the present embodiment.

First, the photosensitive, conductive paste layer 2 used in Embodiment 1 was deposited in the thickness of 20 $\mu$m over the entire surface on the rear plate 101 with the electrodes 102, 103 thereon (FIG. 2(*a*)), as in Embodiment 2.

After that, the region pattern (first pattern) was formed, as illustrated in FIG. 3(*b*), by the mold in the same manner as in Embodiment 2.

After that, the mold 3 was eliminated and the light-intercepting fluid 9 was put in the depressions with a doctor blade, as illustrated in FIG. 3(*c*). On this occasion, the light-intercepting fluid was placed so as to cover the ink portions expected to be removed, in the rough pattern. In the present embodiment the exposure was conducted in this state of FIG. 3(*c*).

After that, the paste layer was developed and baked in the same manner as in Embodiment 2, thereby obtaining the predetermined column-directional wires 107 (second pattern) as illustrated in FIG. 3(*d*).

The light-intercepting fluid was removed together with the unexposed, photosensitive ink in the development.

The present embodiment was able to decrease the waste amount of the photosensitive, conductive paste wasted in the development.

The light-intercepting fluid used in the present invention can be any fluid that can intercept the light during the exposure and that has a certain appropriate viscosity to be held at the placement positions without flowing.

It is, however, desirable to avoid use of fluids with high permeability or solubility to the paste layer. The placement method of such light-intercepting fluid can be, for example, expansion with the doctor blade.

[Embodiment 5]

In the present embodiment the step of forming the rough pattern (first pattern) was carried out using the screen printing method. The image-forming apparatus was constructed in the same manner as in Embodiment 1, except for this.

Figure 4:
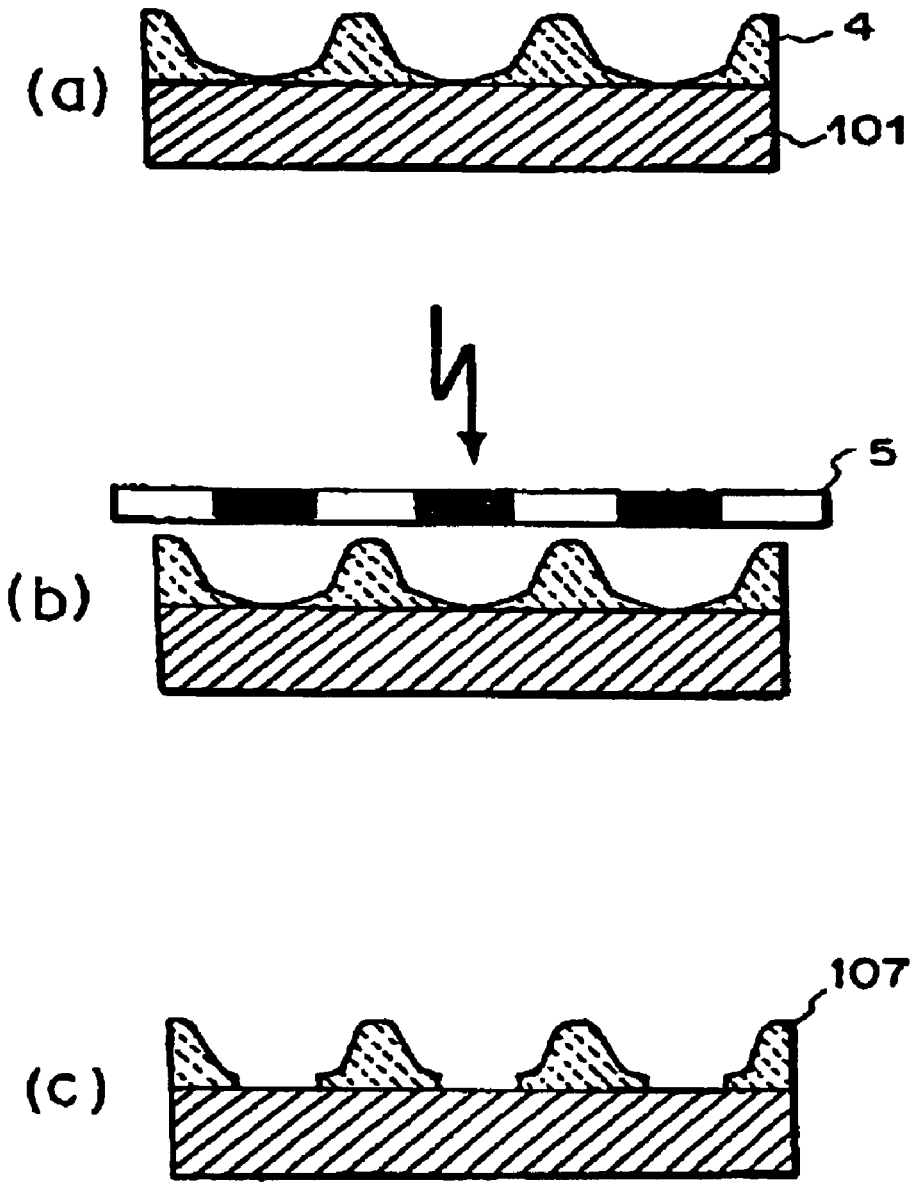
FIG. 4 is a drawing to show another example of steps in the production method of the present invention.

FIG. 4 and FIG. 8 are diagrams to show the process of the present embodiment.

First, the photosensitive, conductive paste used in Embodiment 1 was applied onto only desired areas on the rear plate 101 with the electrodes 102, 103 formed thereon, by the screen printing method using the plate (screen plate) with the desired apertures illustrated in FIG. 15, and then the paste was dried to obtain the rough pattern (first pattern) 4 (FIG. 4(*a*)).

Then the exposure was conducted as illustrated in FIG. 4(*b*), in the same manner as in Embodiment 2.

Further, the paste layer was developed and baked in the same manner as in Embodiment 2, thereby obtaining the pattern (second pattern) of the column-directional wires 107 having the predetermined thickness and width as illustrated in FIG. 4(*c*).

When the display panel 170 illustrated in FIG. 17 was driven in the same manner as in Embodiment 1, the display panel obtained as a result of the present embodiment was able to display the display images with more excellent uniformity over a long period than the display of Embodiment 1.

This is conceivably because the photosensitive, conductive paste was prevented from contaminating the gap portions between the electrodes 102 and the electrodes 103.

[Embodiment 6]

Figure 5:
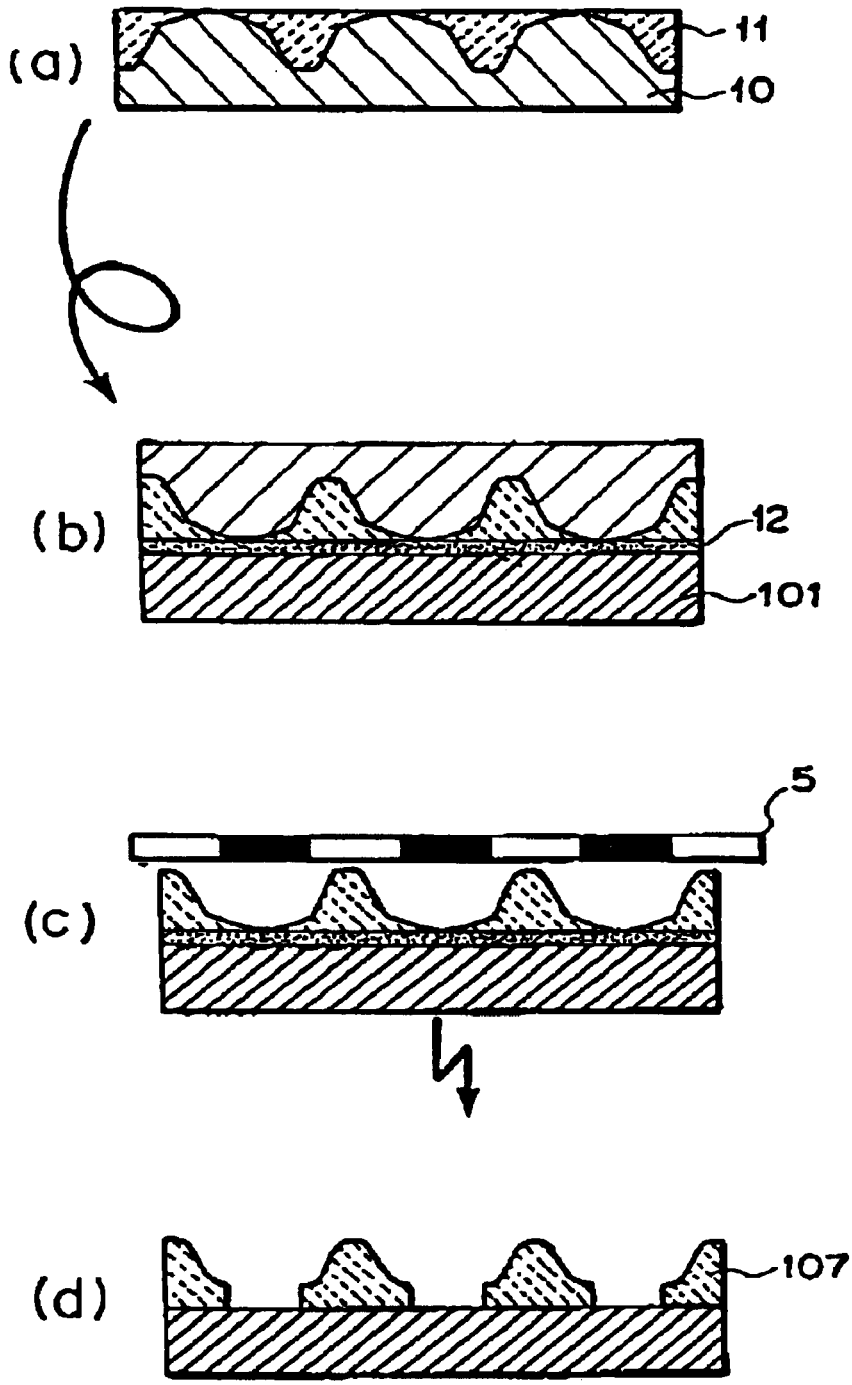
FIG. 5 is a drawing to show another example of steps in the production method of the present invention.

The present embodiment is an example in which the step of forming the rough pattern (first pattern) is carried out by transfer of the photosensitive, conductive paste kept in a transfer mold. The steps other than this are the same as in Embodiment 1. FIG. 5 is a diagram to show the process of the present embodiment.

First, the photosensitive, conductive paste used in Embodiment 1 was applied onto only desired areas on the rear plate 101 with the electrodes 102, 103 formed thereon, by the screen printing method using the plate with the desired apertures, to form the rough pattern (first pattern) 4.

The photosensitive, conductive paste used in Embodiment 1 was first filled into the depressions 15 $\mu$m deep of the transfer mold 10 with the doctor blade to form the filled transfer paste 11, as illustrated in FIG. 5(*a*).

Then the photosensitive, conductive paste used in Embodiment 1 was applied in the thickness of 5 $\mu$m on the rear plate 101 with the electrodes 102, 103 formed thereon, as in Embodiment 2, to form an under paste layer 12.

Then the transfer mold 10 of FIG. 5(*a*) was placed on the substrate 101 and they were kept at 100° C. for ten minutes while being pressed under the press pressure of 500 g per $cm^2$ by the press machine. After that, the filled transfer paste 11 was transferred onto the under layer 12 and the transfer mold 10 was eliminated.

Further, the paste layer was exposed under the same conditions as in Embodiment 2, using a flat photomask 5, as illustrated in FIG. 5(*c*).

After this, the paste layer was developed and baked to obtain the predetermined column-directional wires 107 (second pattern), as illustrated in FIG. 5(*d*).

As a result of the present embodiment, the waste amount of the photosensitive, conductive paste was able to be decreased in the development.

The transfer mold used in the present invention can be any mold if it has the shape that permits the paste to be readily filled into the depressions during the filling of the paste into the depressions.

The material can be either of metal, glass, resin, and so on. The filling of the paste into such a transfer mold can be, for example, the method with the doctor blade.

The press machine used for the mold in the present invention is desirably one capable of imposing the predetermined pressure and capable of heating.

[Embodiment 7]

In the present embodiment the predetermined pattern was formed under the same conditions as in Embodiment 6, except that the under ink layer 12 was not preliminarily formed on the substrate 101 onto which the paste was to be transferred.

As a result of the present embodiment, the waste amount of the photosensitive, conductive paste was able to be decreased in the development.

[Embodiment 8]

In the present embodiment that flat panel display was produced in the form illustrated in FIG. 17, as in Embodiment 1.

The present embodiment is the same as Embodiment 1 except that the column-directional wires 107, the insulating layers 114, and the row-directional wires 106 were formed by a method of applying the photosensitive, conductive paste onto the entire surface of the substrate and then drying, exposing, developing, and baking it. The photosensitive, conductive paste used for formation of the row-directional wires was the same as the photosensitive, conductive paste used for formation of the column-directional wires 107 in Embodiment 1. For formation of the insulating layers 114, a photosensitive member was put into the paste used in the formation of the insulating layers in Embodiment 1. The methods of applying, drying, exposing, developing, and baking the photosensitive, conductive paste were different in the exposure pattern and the baking temperature from the forming method of the column-directional wires in Embodiment 1, but were substantially identical thereto. Thus the detailed description thereof is omitted herein.

When the display panel 170 illustrated in FIG. 17, which was produced in the present embodiment, was driven in the same manner as in Embodiment 1, the high-definition display images were able to be obtained, as in the case of the display of Embodiment 1.

[Embodiment 9]

In the present embodiment, the flat panel display was produced in the form illustrated in FIG. 17 by forming the wires by the screen printing method, as in Embodiment 5.

In the present embodiment, the insulating layers 114 and the row-directional wires 106 were also formed by the screen printing method using the photosensitive paste, as well as the column-directional wires 107.

The insulating layers 114 and the row-directional wires 106 were also formed by first applying the rough pattern (first pattern) with a mask having a desired aperture pattern, drying it, and thereafter exposing, developing, and baking it to obtain the desired pattern (second pattern) of the insulating layers or the row-directional wires 106. The present embodiment is the same as Embodiment 5, except for this.

When the display panel 170 illustrated in FIG. 17, which was produced in the present embodiment, was driven in the same manner as in Embodiment 1, the display panel was able to display the display images with more excellent uniformity over a long period than the display of Embodiment 5.

[Embodiment 10]

In the present embodiment the flat panel display was produced in the form illustrated in FIG. 17, as in Embodiment 1. However, the steps of producing the rear plate of the present embodiment include modified steps from the steps (3) to (7) to Embodiment 1. Since the present embodiment is the same as Embodiment 1 except for that, only the process corresponding to the steps of (3) to (7) in Embodiment 1 will be described hereinafter.

(3) The photosensitive, conductive paste was applied onto the entire surface on the rear plate 101 with the electrodes 102, 103 formed thereon. The photosensitive, conductive paste was a pastelike substance containing Ag particles and the photosensitive member.

(4) After that, the photosensitive, conductive paste was dried in a far infrared furnace. Thereafter, the photosensitive, conductive paste was exposed to light with a shield mask corresponding to the pattern of the column-directional wires 107 and part 106 of the row-directional wires, illustrated in FIG. 20(*b*), and was washed with a solvent to remove unexposed portions.

Figure 20:
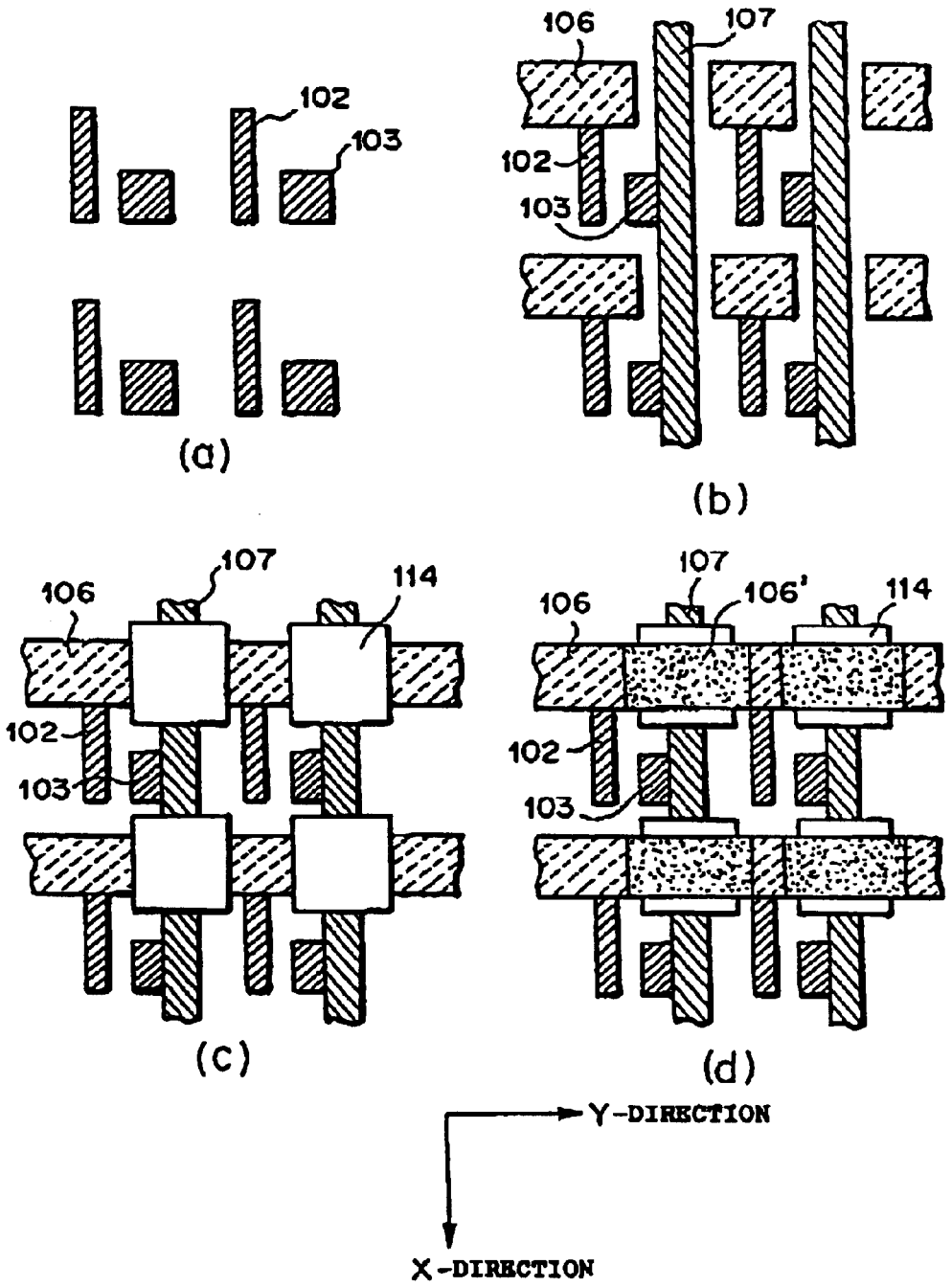
FIG. 20 is a diagram to show other production steps of the electron source substrate according to the present invention.

(5) Further, the rear plate was baked to form the column-directional wires 107 in the same shape as in Embodiment 1 and, part 106 of row-directional wires (FIG. 20(*b*)). This step resulted in covering part of the electrodes 103 by the column-directional wires 107, so that the electrodes 103 were connected to the column-directional wires 107. Since part of the electrodes 102 were covered by the part 106 of row-directional wires, the electrodes 102 were connected to the part 106 of row-directional wires.

(6) Then the insulating layers 114 were formed in a rectangular pattern at the respective intersections between the row-directional wires 106 and column-directional wires 107 by the screen printing method, as illustrated in FIG. 20(*c*). The paste material was a glass paste containing the principal component of lead oxide and a mixture of glass binder and resin. Printing and baking steps of this glass paste were carried out repeatedly for times to form the insulating layers 114.

(7) By the screen printing method, connection wires 106' were made of a silver paste in order to make connections between part 106 of the row-directional wires formed in the separate pattern of the paste containing the Ag particles, glass binder, and resin. This step resulted in connecting the separate, row-directional wires 106 into continuous, row-directional wires.

Through the above steps, the matrix wiring was made in the configuration in which the stripe column-directional wires 107 were perpendicular to the strips row-directional wires 106 through the insulating layers.

The wires formed on the rear plate of the present embodiment as described above demonstrated good electric connection between the row-directional wires (106, 106') at the edge portions of the insulating layers 114 and very good electric connection between the electrodes 102 and the row-directional wires (106, 106').

When the display panel produced in the present embodiment was driven in the same manner as in Embodiment 1, the display panel of the present embodiment showed less temporal variation of the emission spots of the phosphors than the display of Embodiment 1. This is presumably because the area of the insulating layers is smaller than in Embodiment 1 and the effect of charge-up in the insulating layers is less on the beam trajectories.

[Embodiment 11]

Figure 21:
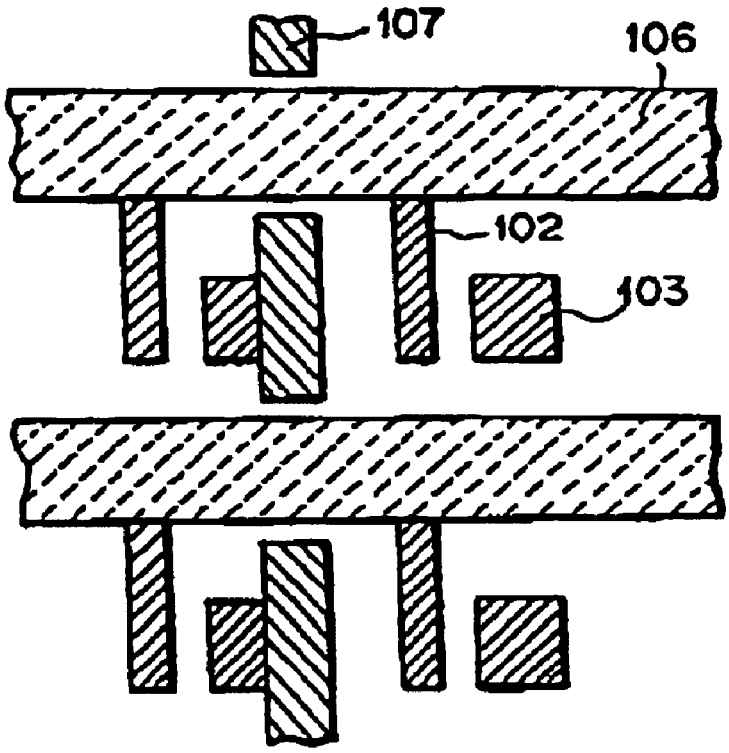
FIG. 21 is a diagram to show other production steps of the electron source substrate according to the present invention.

The present embodiment is an example in which the row-directional wires 106 are continuous while the column-directional wires 10 are intermittently formed at the intersecting portions instead, as against the form of Embodiment 10. In the present embodiment the pattern (FIG. 20(*b*)) formed in the stage of (5) described in Embodiment 10 was formed as illustrated in FIG. 21. The steps thereafter are similar to those in Embodiment 10 to place the insulating layers at the intersections and further form the pattern for electrically connecting the column-directional wires.

The matrix wires formed as described above demonstrated no short between the row-directional wires 106 and the column-directional wires 107 and good connection of the electrodes 102, 103 with the column-directional wires 107 and the row-directional wires 106, as in Embodiment 10.

[Embodiment 12]

In the present embodiment the pattern of FIG. 1(*b*) of Embodiment 20 was formed by the screen printing method.

Specifically, the photosensitive, conductive paste used in Embodiment 1 was applied through the mask having the apparatus corresponding to the pattern illustrated in FIG. 20(*b*), by the screen printing method to form the rough pattern (first pattern).

After that, the paste was dried and thereafter exposed to light in the same manner as Embodiment 1. Then the paste was developed and baked to obtain the pattern (second pattern) illustrated in FIG. 20(*b*).

The insulating layers 114 and, part 106' of row-directional wires were also formed by laying the photosensitive, conductive paste in the rough pattern (first pattern) by the screen printing method and exposing, developing, and baking it to obtain the pattern illustrated in FIG. 20(*d*), as in the above method.

The matrix wires formed as described above demonstrated no short between the row-directional wires 106 and the column-directional wires 107 and good connection of the electrodes 102, 103 with the column-directional wires 107 and the row-directional wires 106, as in Embodiment 10.

Industrial Utilization

According to the present invention, the liquid droplets can be prevented from being sucked into the adjacent wires during formation of the conductive films of the surface conduction electron-emitting devices in the ink jet method, whereby the display images can be obtained with excellent uniformity, in high definition, and in large area.

The present invention can also prevent the photosensitive paste from contaminating the gap portions between the electrodes, whereby the display images can be obtained with excellent uniformity and in large area over a long period.

Further, since the amount of the photosensitive paste wasted in the development can be decreased, the image-forming apparatus of large area can be realized at low cost.

What is claimed is:

1. A method of producing an image-forming apparatus wherein a face plate having phosphors of the three primary colors is opposed to a rear plate comprising a plurality of electron-emitting devices, each having a first electrode and a second electrode, and a plurality of column-directional wirings and row-directional wirings are connected to the plurality of electron-emitting devices, and the phosphors of the three primary colors are disposed in the same order repeatedly along the row direction, said method comprising:

(a) a step of arranging a plurality of first electrodes and second electrodes on the rear plate such that first and second electrodes of each of the electron-emitting devices are opposed to each other in the row direction;

(b) a step of forming the plurality of column-directional wirings, wherein each of the column-directional wirings connects commonly a plurality of the first electrodes;

(c) a step of forming the plurality of row-directional wirings, wherein each of the row-directional wirings connects commonly a plurality of the second electrodes, intervals of the row-directional wirings are larger than those of the column-directional wirings, each of the row-directional wirings cross some of the column-directional wirings; and the row-directional wirings are formed so as to be insulated from the column-directional wirings; and (d) a step of applying a liquid containing at least a metal or a semiconductor so as to connect the first and second electrodes to each other according to an ink jet method, and wherein said step of forming the column-directional wirings comprises:

a step of forming a film comprising a photosensitive material and an electroconductive material on the rear plate;

a step of irradiating desired areas of the film with light;

a step of patterning the film; and a step of baking the patterned film.

2. The production method of the image-forming apparatus according to claim 1, wherein said step of forming the film comprising the photosensitive material and the electroconductive material on the rear plate is a step of applying the film in a first pattern.

3. The production method of the image-forming apparatus according to claim 2, wherein said step of applying the first pattern is a step of selectively forming the film comprising the photosensitive material and electroconductive material on the rear plate through apertures of a mask having the apertures of a desired shape.

4. The production method of the image-forming apparatus according to either one of claims 1 to 3, wherein at each of the intersections, each of the column-directional wirings is disposed between each of the row directional wirings and the rear plate.

5. The production method of the image-forming apparatus according to any one of claims 1 to 3, wherein the image-forming apparatus further comprises a spacer for supporting the space between the face plate and rear plate, the spacer being placed on the row-directional wirings.

6. The production method of the image-forming apparatus according to any one of claims 1 to 3, further comprising the steps of:

connecting a scanning circuit for generating a scanning signal to the plurality of column-directional wirings; and connecting a modulation circuit for generating a modulation signal to the plurality of column-directional wirings.

7. The production method of the image-forming apparatus according to any one of claims 1 to 3, wherein the plurality of row-directional wirings are formed by using a screen printing method.

8. A method of producing an image-forming apparatus which comprises a face plate having phosphors, a rear plate having a plurality of electron-emitting devices and a plurality of wirings connected to the plurality of electron-emitting devices, said method comprising the steps of:

(a) arranging a plurality of first electrodes and second electrodes on the rear plate;

(b) forming a plurality of column-directional wirings, wherein each of the column-directional wirings connects some of the first electrodes, and (c) forming a plurality of row-directional wirings, wherein each of the row-directional wirings connects some of the second electrodes, each of the row-directional wirings cross some of the column-directional wirings and the row directional wirings are formed so as to be insulated from the column-directional wirings;

wherein a cross-sectional area of the row-directional wirings is larger than a cross sectional area of the column-directional wirings, and wherein said step of forming the column-directional wirings comprises:

(d) forming a film comprising a photosensitive material and an electroconductive material on the rear plate;

(e) irradiating desired areas of the film with light;

(f) patterning the film; and (g) baking the patterned film.

9. A method of producing an image-forming apparatus which comprises a face plate having phosphors, a rear plate having a plurality of electron-emitting devices and a plurality of wirings connected to the plurality of electron-emitting devices, said method comprising the steps of:

(a) arranging a plurality of first electrodes and second electrodes on the rear plate;

(b) forming a plurality of column-directional wirings, wherein each of the column-directional wirings connects some of the first electrodes;

(c) forming a plurality of row-directional wirings, wherein each of the row-directional wirings connects some of the second electrodes, each of the row-directional wirings cross some of the column-directional wirings and the row-directional wirings are formed so as to be insulated from the column directional wirings;

wherein a width of the row-directional wirings is wider than a width of the column-directional wirings, and wherein said step of forming the column-directional wirings comprises:

(d) forming a film comprising a photosensitive material and an electroconductive material on the rear plate;

(e) irradiating desired areas of the film with light;

(f) patterning the film; and (g) baking the patterned film.

10. A method of producing an image-forming apparatus which comprises a face plate having phosphors, a rear plate having a plurality of electron-emitting devices and a plurality of wirings connected to the plurality of electron-emitting devices, said method comprising the steps of:

(a) arranging a plurality of first electrodes and second electrodes on the rear plate;

(b) forming a plurality of column-directional wirings, wherein each of the column-directional wirings connects some of the first electrodes;

(c) forming a plurality of row-directional wirings, wherein each of the row-directional wirings connects some of the second electrodes, each of the row-directional wirings cross some of the column-directional wirings and the row-directional wirings are formed so as to be insulated from the column-directional wirings; and wherein a thickness of the row-directional wirings is thicker than a thickness of the column-directional wirings, and wherein said step of forming the column-directional wirings comprises:

(d) forming a film comprising a photosensitive material and an electroconductive material on the rear plate;

(e) irradiating desired area of the film with light;

(f) patterning the film; and (g) baking the patterned film.

11. A method of producing an image-forming apparatus wherein a face plate having a phosphor is opposed to a rear plate comprising a plurality of electron-emitting devices, each having a first electrode and a second electrode, and a plurality of wirings connects to the plurality of electron-emitting devices, said method comprising:

(a) a step of arranging a plurality of first electrodes and second electrodes on the rear plate;

(b) a step of selectively forming a film comprising a photosensitive material and an electroconductive material on the rear plate through apertures of a mask having the apertures of a desired shape;

(c) a step of irradiating desired area of the film formed on the rear plate, with light;

(d) a step of patterning the film;

(e) a step of baking the patterned film to form a plurality of wirings connected to the electrodes; and (f) a step of forming an electroconductive film so as to connect the first and second electrodes to each other.

12. The production method of the image-forming apparatus according to claim 11, said production method of the image-forming apparatus further comprising a step of forming a fissure in the electroconductive film placed between the electrodes.

13. The production method of the image-forming apparatus according to claim 12, wherein the fissure is formed by allowing an electric current to flow in the electroconductive film.

14. A method of producing an electron source substrate which comprises a rear plate having a plurality of electron-emitting devices and a plurality of wiring connected to the plurality of electron-emitting devices, said method comprising the steps of:

(a) forming a plurality of column-directional wirings; and (b) forming a plurality of row-directional wirings, wherein each of the row-directional wirings cross some of the column-directional wirings, and the row-directional wirings are formed so as to be insulated from the column-directional wirings, wherein a cross-sectional area of the row-directional wirings is larger than a cross-sectional area of the column-directional wirings, and wherein said step of forming the column-directional wiring comprises:

(c) forming a film comprising a photosensitive material and an electroconductive material on the rear plate;

(d) irradiating desired areas of the film with light;

(e) patterning the film; and (f) baking the patterned film.

15. A method of producing an electron source substrate which comprises a rear plate having a plurality of electron-emitting devices and a plurality of wirings connected to the plurality of electron-emitting devices, said method comprising the steps:

(a) forming a plurality of column-directional wirings; and (b) forming a plurality of row-directional wirings, wherein each of the row-directional wirings cross some of the column-directional wirings and the row-directional wirings are formed so as to be insulated from the column-directional wirings, wherein a width of the row-directional wirings is wider than a width of the column-directional wirings, and wherein said step of forming the column-directional wirings comprises:

(c) forming a film comprising a photosensitive material and an electroconductive material on the rear plate;

(d) irradiating desired areas of the film with light;

(e) patterning the film; and (f) baking the patterned film.

16. A method of producing an electron source substrate which comprises a rear plate having a plurality of electron-emitting devices and a plurality of wirings connected to the plurality of electron-emitting devices, said method comprising the steps of:

(a) forming a plurality of column-directional wirings; and (b) forming a plurality of row-directional wirings, wherein each of the row-directional wirings cross some of the column-directional wirings, and said row-directional wirings are formed so as to be insulated from said column-directional wirings, wherein a thickness of the row-directional wirings is thicker than a thickness of the column-directional wirings, and wherein said step of forming the column-directional wiring comprises:

(c) forming a film comprising a photosensitive material and an electroconductive material on the rear plate;

(d) irradiating desired areas of the film with light;

(e) patterning the film; and (f) baking the patterned film.

* * * * *

UNITED STATES PATENT AND TRADEMARK OFFICE

CERTIFICATE OF CORRECTION

PATENT NO. : 6,986,692 B1
APPLICATION NO. : 09/722705
DATED : January 17, 2006
INVENTOR(S) : Yoshihiro Yanagisawa It is certified that error appears in the above-identified patent and that said Letters Patent is hereby corrected as shown below:

Column 7:
Line 40, “Pt.” should read --Pt,--.
Line 48, “film 4, “ should read --film 104,--.

Column 8:
Line 52, “electrode” should read --electrodes--.

Column 9:
Line 8, “as” should read --so as--.

Column 11:
Line 19, “make” should read --makes--.

Column 15:
Line 60, “obtain” should read --be obtained--.

Column 17:
Line 45, “then” should read --than--.

Column 21:
Line 13, “(11)” should read --(14)--;
Line 15, “(12) After than,” should read --(15) After that,--.
Line 19, “(13)” should read --(16)--.

Column 22:
Line 39, “obtain” should read --be obtained--.

Column 25:
Line 27, “that” should read --the--.

Column 26:
Line 44, “for” should read --four--.

Column 27:
Line 20, “Embodiment 20” should read --Embodiment 2--.

Column 28:
Line 12, “wirings;” should read --wirings,--.
Line 40, “either” should read --any--.

UNITED STATES PATENT AND TRADEMARK OFFICE

CERTIFICATE OF CORRECTION

PATENT NO. : 6,986,692 B1
APPLICATION NO. : 09/722705
DATED : January 17, 2006
INVENTOR(S) : Yoshihiro Yanagisawa It is certified that error appears in the above-identified patent and that said Letters Patent is hereby corrected as shown below:

Column 29:

Line 5, “electrodes,” should read --electrodes;--.
Line 12, “wirings;” should read --wirings,--.
Line 14, “cross sectional” should read --cross-sectional--.
Line 41, “wirings;” should read --wirings,--.

Column 30:

Line 2, “wirings;” should read --wirings,--.
Line 11, “area” should read --areas--.

Signed and Sealed this

Nineteenth Day of September, 2006

JON W. DUDAS
*Director of the United States Patent and Trademark Office*